US008997882B2

(12) United States Patent
Turley et al.

(10) Patent No.: US 8,997,882 B2
(45) Date of Patent: Apr. 7, 2015

(54) STAGE TOOL

(75) Inventors: Rocky A. Turley, Houston, TX (US); Brent J. Lirette, Cypress, TX (US); Huy V. Le, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 462 days.

(21) Appl. No.: 13/398,833

(22) Filed: Feb. 16, 2012

(65) Prior Publication Data

US 2012/0205091 A1 Aug. 16, 2012

Related U.S. Application Data

(63) Continuation-in-part of application No. 13/029,022, filed on Feb. 16, 2011.

(60) Provisional application No. 61/563,016, filed on Nov. 22, 2011.

(51) Int. Cl.

| | |
|---|---|
| ***E21B 43/10*** | (2006.01) |
| ***E21B 23/06*** | (2006.01) |
| ***E21B 33/1295*** | (2006.01) |
| ***E21B 33/12*** | (2006.01) |
| ***E21B 33/129*** | (2006.01) |

(52) U.S. Cl.

CPC ..... *E21B 33/1216* (2013.01); *E21B 43/10* (2013.01); *E21B 33/1295* (2013.01); *E21B 23/06* (2013.01); *E21B 33/1291* (2013.01); *E21B 43/103* (2013.01); *E21B 43/105* (2013.01)

(58) Field of Classification Search

USPC ..... 166/382, 387, 141, 208; 277/339, 328

See application file for complete search history.

(56) References Cited

U.S. PATENT DOCUMENTS

| | | | |
|---|---|---|---|
| 2,125,665 | A | 8/1938 | Bettis |
| 2,652,894 | A | 9/1953 | Brown et al. |
| 3,147,016 | A | 9/1964 | Traufler |
| 3,215,208 | A | 11/1965 | Tamplen |
| 3,227,462 | A | 1/1966 | Tamplen |
| 3,278,192 | A | 10/1966 | Tamplen |
| 3,374,838 | A | 3/1968 | Current |
| 3,631,926 | A | 1/1972 | Young |
| 3,784,214 | A | 1/1974 | Tamplen |
| 4,482,086 | A | 11/1984 | Wagner et al. |
| 4,588,029 | A | 5/1986 | Blizzard |

(Continued)

FOREIGN PATENT DOCUMENTS

| | | |
|---|---|---|
| RU | 1 367 586 | 11/1996 |

OTHER PUBLICATIONS

International Search Report and Written Opinion; International Application No. PCT/US2012/025531; mailed Jan. 8, 2013.

(Continued)

*Primary Examiner* — Cathleen Hutchins

(74) *Attorney, Agent, or Firm* — Patterson & Sheridan, L.L.P.

(57) ABSTRACT

The present invention generally relates to a stage tool. In one aspect, a downhole tool for use in a wellbore is provided. The tool includes a body having a bore. The tool further includes a seal assembly attached to the body. The seal assembly having an expandable annular member, a seal member and an expander sleeve, wherein the seal member includes one or more anti-extrusion spring bands embedded within the seal member. The tool further includes a slip assembly attached to the body. The slip assembly includes slips that are configured to engage the wellbore.

16 Claims, 22 Drawing Sheets

(56) References Cited

U.S. PATENT DOCUMENTS

| | | | | |
|---|---|---|---|---|
| 4,809,989 | A | 3/1989 | Kernal | |
| 5,052,483 | A | 10/1991 | Hudson | |
| 5,076,356 | A | 12/1991 | Reimert | |
| 5,311,938 | A | 5/1994 | Hendrickson et al. | |
| 5,333,692 | A | 8/1994 | Baugh et al. | |
| 5,355,961 | A | 10/1994 | Gariepy et al. | |
| 5,433,269 | A | 7/1995 | Hendrickson | |
| 5,462,121 | A | 10/1995 | Schmuck et al. | |
| 5,467,822 | A | 11/1995 | Zwart | |
| 5,511,620 | A | 4/1996 | Baugh et al. | |
| 5,603,511 | A | 2/1997 | Keyser et al. | |
| 5,685,369 | A | 11/1997 | Ellis et al. | |
| 5,857,520 | A | 1/1999 | Mullen et al. | |
| 6,123,148 | A | 9/2000 | Oneal | |
| 6,142,227 | A | 11/2000 | Hiorth et al. | |
| 6,409,175 | B1 | 6/2002 | Evans et al. | |
| 6,425,444 | B1 | 7/2002 | Metcalfe et al. | |
| 6,446,717 | B1 | 9/2002 | White et al. | |
| 6,666,276 | B1 | 12/2003 | Yokley et al. | |
| 6,691,789 | B2 | 2/2004 | Jackson et al. | |
| 6,705,615 | B2 | 3/2004 | Milberger et al. | |
| 6,763,893 | B2 | 7/2004 | Braddick | |
| 6,769,491 | B2 | 8/2004 | Zimmerman et al. | |
| 6,772,844 | B2 | 8/2004 | Lloyd et al. | |
| 6,789,622 | B1 | 9/2004 | Ducasse et al. | |
| 6,814,143 | B2 | 11/2004 | Braddick | |
| 6,902,008 | B2 | 6/2005 | Hirth et al. | |
| 6,962,206 | B2 | 11/2005 | Hirth et al. | |
| 7,036,581 | B2 | 5/2006 | Trahan | |
| 7,165,622 | B2 | 1/2007 | Hirth et al. | |
| 7,172,029 | B2 | 2/2007 | Hirth et al. | |
| 7,213,814 | B2 | 5/2007 | Hurlbert et al. | |
| 7,225,880 | B2 | 6/2007 | Braddick | |
| 7,234,533 | B2 | 6/2007 | Gambier | |
| 7,252,142 | B2 | 8/2007 | Brezinski et al. | |
| 7,322,422 | B2 | 1/2008 | Patel | |
| 7,360,592 | B2 | 4/2008 | McMahan | |
| 7,367,404 | B2 | 5/2008 | Simpson et al. | |
| 7,370,708 | B2 | 5/2008 | Simpson et al. | |
| 7,380,592 | B2 | 6/2008 | Atkins et al. | |
| 7,387,170 | B2 | 6/2008 | Doane et al. | |
| 7,407,165 | B1 | 8/2008 | Chisnell | |
| 7,441,606 | B2 | 10/2008 | Maguire | |
| 7,469,750 | B2 | 12/2008 | Carr | |
| 7,493,945 | B2 | 2/2009 | Doane et al. | |
| 7,665,532 | B2 | 2/2010 | Cook et al. | |
| 7,703,542 | B2 | 4/2010 | O'Connor et al. | |
| 7,740,248 | B2 | 6/2010 | Keene et al. | |
| 7,748,467 | B2 | 7/2010 | Doane | |
| 7,766,088 | B2 | 8/2010 | Saucier et al. | |
| 7,775,290 | B2 | 8/2010 | Brisco et al. | |
| 7,779,927 | B2 * | 8/2010 | Turley et al. | 166/387 |
| 7,784,797 | B2 | 8/2010 | Baugh et al. | |
| 7,921,921 | B2 | 4/2011 | Bishop et al. | |
| 8,066,065 | B2 | 11/2011 | Buckner | |
| 8,109,340 | B2 | 2/2012 | Doane et al. | |
| 8,459,347 | B2 | 6/2013 | Stout | |
| 2002/0088616 | A1 * | 7/2002 | Swor et al. | 166/118 |
| 2004/0060706 | A1 | 4/2004 | Stephenson | |
| 2004/0123983 | A1 | 7/2004 | Cook et al. | |
| 2005/0172472 | A1 | 8/2005 | Verger et al. | |
| 2005/0173110 | A1 | 8/2005 | Trahan | |
| 2006/0186602 | A1 | 8/2006 | Martin et al. | |
| 2006/0272827 | A1 * | 12/2006 | Adam et al. | 166/380 |
| 2007/0151725 | A1 * | 7/2007 | Cook et al. | 166/208 |
| 2009/0205843 | A1 | 8/2009 | Gandikota et al. | |
| 2010/0089591 | A1 | 4/2010 | Thomson et al. | |
| 2011/0037230 | A1 | 2/2011 | O'Connor et al. | |
| 2013/0292138 | A1 | 11/2013 | Givens et al. | |

OTHER PUBLICATIONS

International Search Report and Written Opinion; International Application No. PCT/US2012/025508; mailed Jan. 18, 2013.

International Search Report and Written Opinion; International Application No. PCT/US2012/025533; mailed Jan. 18, 2013.

* cited by examiner

STAGE TOOL

CROSS-REFERENCE TO RELATED APPLICATIONS

This application claims benefit of U.S. provisional patent application Ser. No. 61/563,016 filed Nov. 22, 2011 and is a continuation-in-part of co-pending U.S. patent application Ser. No. 13/029,022, filed Feb. 16, 2011. Each of the aforementioned related patent applications is herein incorporated by reference.

BACKGROUND OF THE INVENTION

1. Field of the Invention

Embodiments of the present invention generally relate to a downhole expansion assembly. More particularly, embodiments of the present invention relate to seals for the downhole expansion assembly.

2. Description of the Related Art

In the oilfield industry, downhole tools are employed in the wellbore at different stages of operation of the well. For example, an expandable liner hanger may be employed during the formation stage of the well. After a first string of casing is set in the wellbore, the well is drilled a designated depth and a liner assembly is run into the well to a depth whereby the upper portion of the liner assembly is overlapping a lower portion of the first string of casing. The liner assembly is fixed in the wellbore by expanding a liner hanger into the surrounding casing and then cementing the liner assembly in the well. The liner hanger includes seal members disposed on an outer surface of the liner hanger. The seal members are configured to create a seal with the surrounding casing upon expansion of the liner hanger.

In another example, a packer may be employed during the production stage of the well. The packer typically includes a packer assembly with seal members. The packer may seal an annulus formed between production tubing disposed within casing of the wellbore. Alternatively, some packers seal an annulus between the outside of a tubular and an unlined borehole. Routine uses of packers include the protection of casing from pressure, both well and stimulation pressures, and protection of the wellbore casing from corrosive fluids. Packers may also be used to hold kill fluids or treating fluids in the casing annulus.

Both the liner hanger and the packer include seal members that are configured to create a seal with the surrounding casing or an unlined borehole. Each seal member is typically disposed in a groove (or gland) formed in an expandable tubular assembly of the liner hanger or packer. However, the seal member may extrude out of the groove during expansion of the expandable tubular assembly due to the characteristics of the seal member. Further, the seal member may extrude out of the groove after expansion of the expandable tubular assembly due to pressure differentials applied to the seal member. Therefore, there is a need for extrusion-resistant seals for use with an expandable tubular assembly.

SUMMARY OF THE INVENTION

The present invention generally relates to an anchor seal for an expandable tubular assembly. In one aspect, an anchoring seal assembly for creating a seal portion and an anchor portion between a first tubular that is disposed within a second tubular is provided. The anchoring seal assembly includes an expandable annular member attached to the first tubular. The annular member has an outer surface and an inner surface.

The anchoring seal assembly further includes a seal member disposed in a groove formed in the outer surface of the expandable annular member. The seal member has one or more anti-extrusion spring bands embedded within the seal member, wherein the outer surface of the expandable annular member adjacent the groove includes a rough surface. The anchoring seal assembly also includes an expander sleeve having a tapered outer surface and an inner bore. The expander sleeve is movable between a first position in which the expander sleeve is disposed outside of the expandable annular member and a second position in which the expander sleeve is disposed inside of the expandable annular member, wherein the expander sleeve is configured to radially expand the expandable annular member into contact with an inner wall of the second tubular to create the seal portion and the anchor portion as the expander sleeve moves from the first position to the second position.

In another aspect, a method of creating a seal portion and an anchor portion between a first tubular and a second tubular is provided. The method includes the step of positioning the first tubular within the second tubular. The first tubular has an annular member with a groove and a rough outer surface, wherein a seal member with at least one anti-extrusion band is disposed within the groove and wherein a gap is formed between a side of the seal member and a side of the groove. The method further includes the step of expanding the annular member radially outward, which causes the at least one anti-extrusion band to move toward an interface area between the first tubular and the second tubular. The method also includes the step of urging the annular member into contact with an inner wall of the second tubular to create the seal portion and the anchor portion between the first tubular and the second tubular.

In another aspect, a seal assembly for creating a seal between a first tubular and a second tubular is provided. The seal assembly includes an annular member attached to the first tubular, the annular member having a groove formed on an outer surface of the annular member. The seal assembly further includes a seal member disposed in the groove, the seal member having one or more anti-extrusion bands. The seal member is configured to be expandable radially outward into contact with an inner wall of the second tubular by the application of an outwardly directed force supplied to an inner surface of the annular member. Additionally, the seal assembly includes a gap defined between the seal member and a side of the groove.

In another aspect, a method of creating a seal between a first tubular and a second tubular is provided. The method includes the step of positioning the first tubular within the second tubular, the first tubular having a annular member with a groove, wherein a seal member with at least one anti-extrusion band is disposed within the groove and wherein a gap is formed between a side of the seal member and a side of the groove. The method further includes the step of expanding the annular member radially outward, which causes the first anti-extrusion band and the second anti-extrusion band to move toward a first interface area and a second interface area between the annular member and the second tubular. The method also includes the step of urging the seal member into contact with an inner wall of the second tubular to create the seal between the first tubular and the second tubular.

In yet another aspect, a seal assembly for creating a seal between a first tubular and a second tubular is provided. The seal assembly includes an annular member attached to the first tubular, the annular member having a groove formed on an outer surface thereof. The seal assembly further includes a seal member disposed in the groove of the annular member such that a side of the seal member is spaced apart from a side of the groove, the seal member having one or more anti-extrusion bands, wherein the one or more anti-extrusion bands move toward an interface area between the annular member and the second tubular upon expansion of the annular member.

In a further aspect, a hanger assembly is provided. The hanger assembly includes an expandable annular member having an outer surface and an inner surface. The hanger assembly further includes a seal member disposed in a groove formed in the outer surface of the expandable annular member, the seal member having one or more anti-extrusion spring bands embedded within the seal member. The hanger assembly also includes an expander sleeve having a tapered outer surface and an inner bore. The expander sleeve is movable between a first position in which the expander sleeve is disposed outside of the expandable annular member and a second position in which the expander sleeve is disposed inside of the expandable annular member. The expander sleeve is configured to radially expand the expandable annular member as the expander sleeve moves from the first position to the second position.

In a further aspect, a downhole tool for use in a wellbore is provided. The tool includes a body having a bore. The tool further includes a seal assembly attached to the body. The seal assembly having an expandable annular member, a seal member and an expander sleeve, wherein the seal member includes one or more anti-extrusion spring bands embedded within the seal member. The tool further includes a slip assembly attached to the body. The slip assembly includes slips that are configured to engage the wellbore.

In a further aspect, downhole tool for use in a wellbore is provided. The tool includes a tubular having a tapered outer surface. The tool further includes an expandable annular member disposed on the tubular. The expandable member has an anchor portion. The tool further includes a seal member disposed in a groove of the expandable annular member. The seal member has one or more anti-extrusion bands, wherein the seal member and the anchor portion are configured to be expandable radially outward into contact with the wellbore as the expandable annular member moves along the tapered outer surface of the tubular.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

The present invention generally relates to extrusion-resistant seals for a downhole tool. The extrusion-resistant seals will be described herein in relation to a liner hanger in FIGS. 1-10, a packer in FIGS. 11-15 and a hanger assembly in FIGS. 16-17. It is to be understood, however, that the extrusion-resistant seals may also be used with other downhole tools without departing from principles of the present invention. Further, the extrusion-resistant seals may be used in a downhole tool that is disposed within a cased wellbore or within an open-hole wellbore. To better understand the novelty of the extrusion-resistant seals of the present invention and the methods of use thereof, reference is hereafter made to the accompanying drawings.

Figure 1:
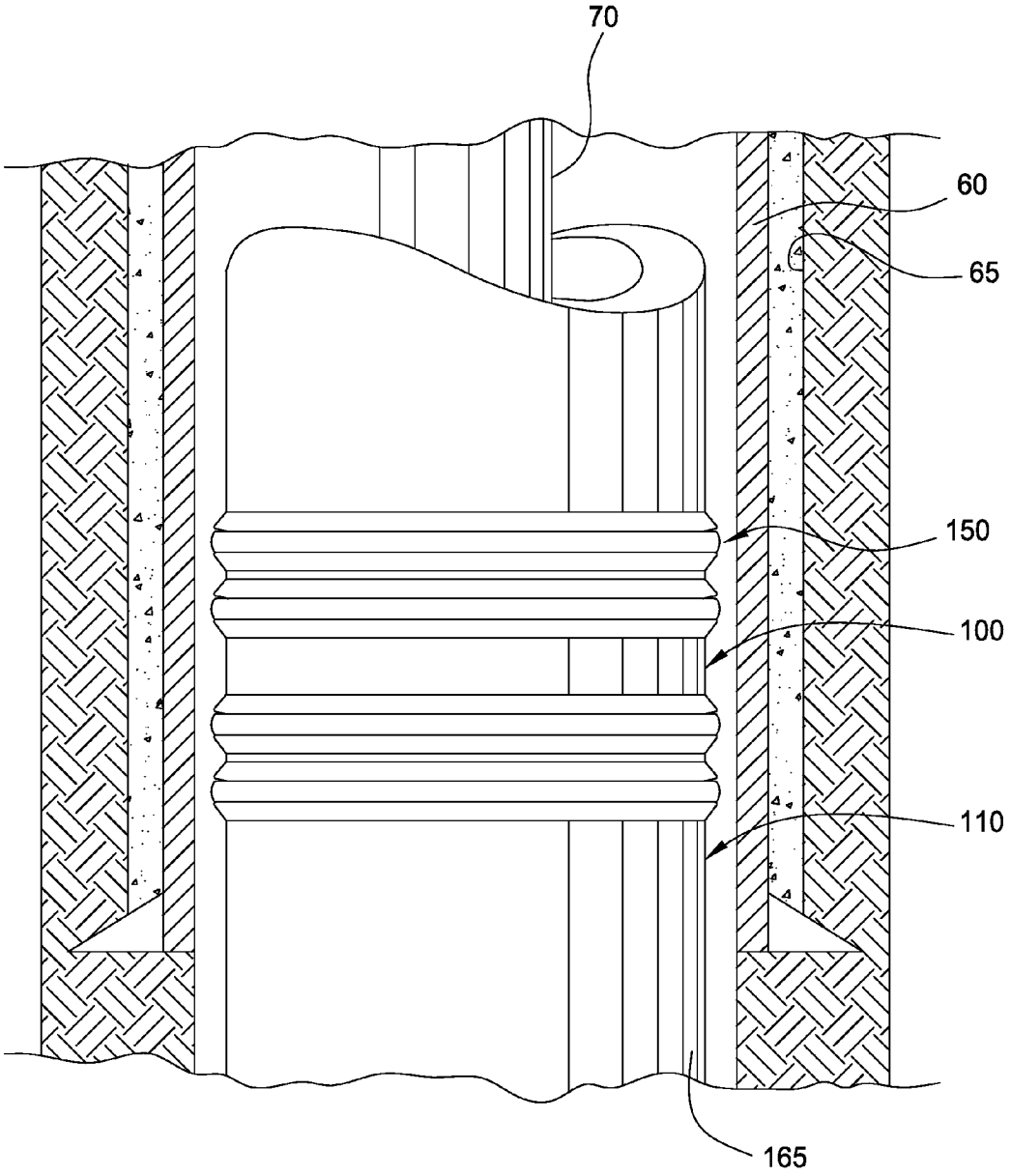
FIG. 1 illustrates a view of an expandable hanger in a run-in (unset) position.

FIG. 1 illustrates a view of an expandable hanger 100 in a run-in (unset) position. At the stage of completion shown in FIG. 1, a wellbore 65 has been lined with a string of casing 60. Thereafter, a subsequent liner assembly 110 is positioned proximate the lower end of the casing 60. Typically, the liner assembly 110 is lowered into the wellbore 65 by a running tool disposed at the lower end of a work string 70.

The liner assembly 110 includes a tubular 165 and the expandable hanger 100 of this present invention. The hanger 100 is an annular member that is used to attach or hang the tubular 165 from an internal wall of the casing 60. The expandable hanger 100 includes a plurality of seal assemblies 150 disposed on the outer surface of the hanger 100. The plurality of seal assemblies 150 are circumferentially spaced around the hanger 100 to create a seal between liner assembly 110 and the casing 60 upon expansion of the hanger 100. Although the hanger 100 in FIG. 1 shows four seal assemblies 150, any number of seal assemblies 150 may be attached to liner assembly 110 without departing from principles of the present invention.

Figure 2:
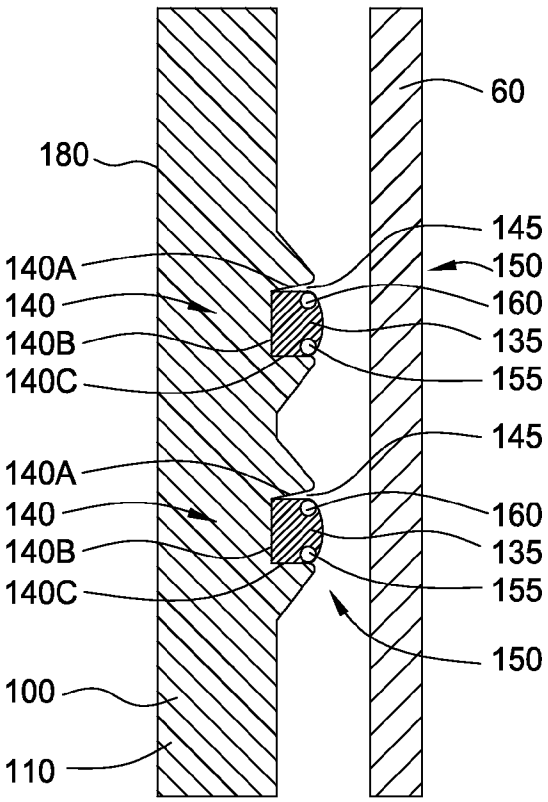
FIG. 2 illustrates a view of a seal assembly of the expandable hanger.

FIG. 2 illustrates an enlarged view of the seal assemblies 150 in the run-in position. For clarity, the wellbore 65 is not shown in FIGS. 2-6. Each seal assembly 150 includes a seal ring 135 disposed in a gland 140. The gland 140 includes a first side 140A, a second side 140B and a third side 140C. In the embodiment shown in FIG. 2, a bonding material, such as glue (or other attachment means), may be used on sides 140B, 140C during the fabrication stage of the seal assembly 150 to attach the seal ring 135 in the gland 140. Bonding the seal ring 135 in the gland 140 is useful to prevent the seal ring 135 from becoming unstable and swab off when the hanger 100 is positioned in the casing 60 and prior to expansion of the hanger 100. In one embodiment, the side 140A has an angle $\alpha$ (see FIG. 5) of approximately 100 degrees prior to expansion, and side 140A has an angle $\beta$ (see FIG. 6) between about 94 degrees and about 98 degrees after expansion of the seal assembly 150.

Figure 5:
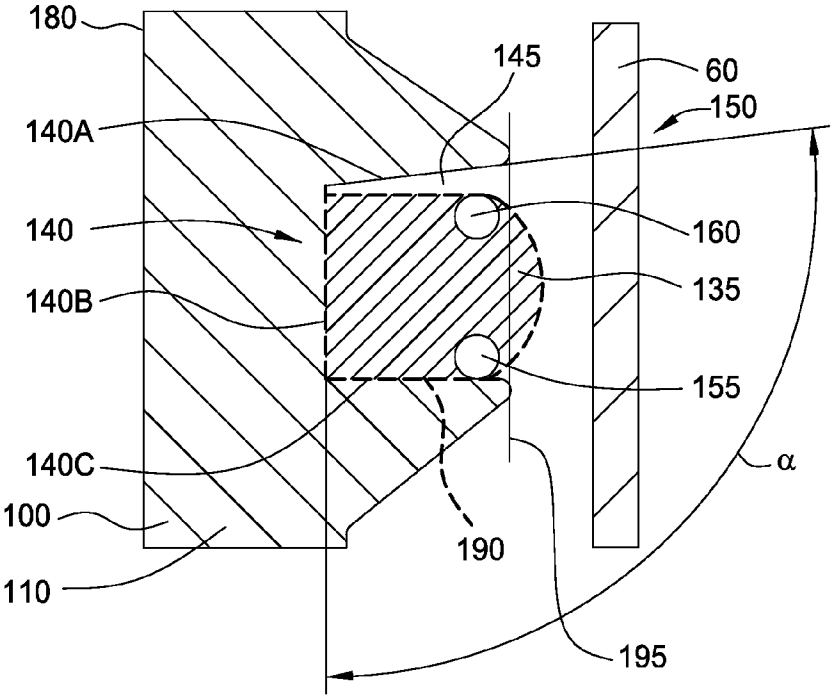
FIG. 5 illustrates an enlarged view of the seal assembly prior to expansion.

As shown in FIG. 5, a volume gap 145 is created between the seal ring 135 and the side 140A of the gland 140. Generally, the volume gap 145 is used to substantially prevent distortion of the seal ring 135 upon expansion of the hanger 100. The volume gap 145 is a free-space (empty space, clearance or void) between a portion of the seal ring 135 and a portion of the gland 140 prior to expansion of the hanger 100. In other words, during the fabrication process of the hanger, the volume gap 145 is created by positioning the seal ring 135 within the gland 140 such that the seal ring 135 is spaced apart from at least one side of the gland 140. Even though the volume gap 145 in FIG. 5 is created by having a side of the gland 140 at an angle, the volume gap 145 may be created in any configuration (see FIGS. 7-10, for example) without departing from principles of the present invention. Additionally, the size of the volume gap 145 may vary depending on the configuration of the gland 140. In one embodiment, the gland 140 has 3-5% more volume due to the volume gap 145 than a standard gland without a volume gap.

Referring back to FIG. 2, the seal ring 135 includes one or more anti-extrusion bands, such as a first seal band 155 (first anti-extrusion band) and a second seal band 160 (second anti-extrusion band). As shown, the seal bands 155, 160 are embedded in the seal ring 135 in an upper corner of each side of the seal ring 135. In one embodiment, the seal bands 155, 160 are disposed on an outer circumference of the seal ring 135. In another embodiment, the seal bands 155, 160 are springs. The seal bands 155, 160 may be used to limit the extrusion of the seal ring 135 during expansion of the seal assembly 150. The seal bands 155, 160 may also be used to limit the extrusion of applied differential pressure after expansion of the seal assembly 150.

Figure 3:
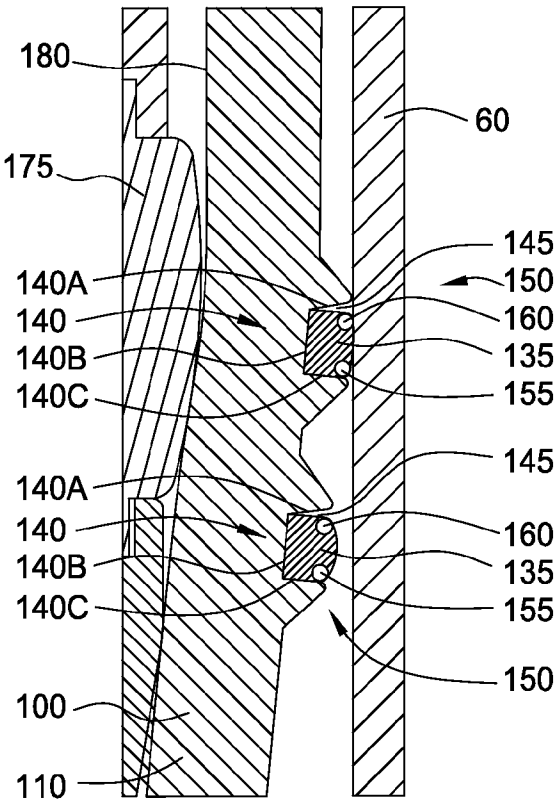
FIG. 3 illustrates a view of the seal assembly during expansion of the expandable hanger.
Figure 4B:
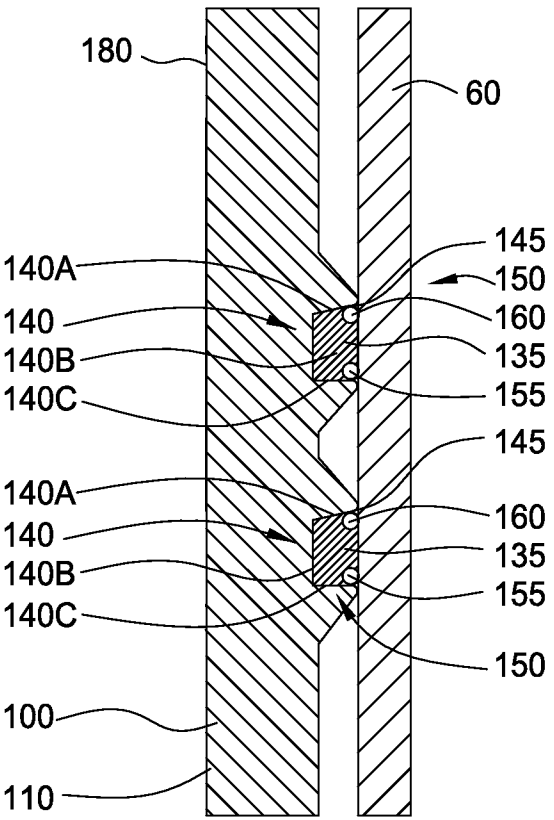
FIGS. 4A and 4B illustrate a view of the seal assembly after expansion of the expandable hanger.
Figure 4A:
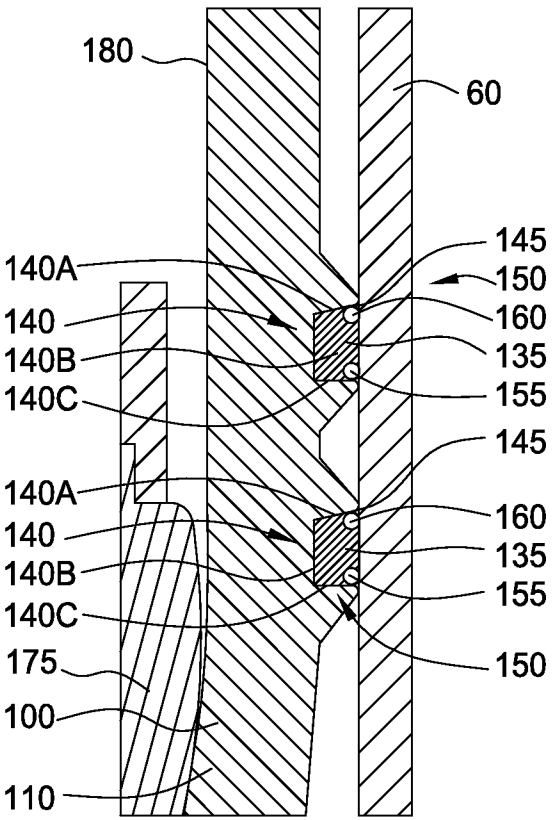

FIG. 3 illustrates a view of the seal assemblies 150 during expansion and FIGS. 4A and 4B illustrate the seal assemblies 150 after expansion. As shown, an axially movable expander tool 175 contacts an inner surface 180 of the liner assembly 110. Expander tools are well known in the art and are generally used to radially enlarge an expandable tubular by urging the expander tool 175 axially through the tubular, thereby swaging the tubular wall radially outward as the larger diameter tool is forced through the smaller-diameter tubular member. The expander tool 175 may be attached to a threaded mandrel which is rotated to move the expander tool 175 axially through the hanger 100 and expand the hanger 100 outward in contact with the casing 60. It is to be understood, however, that other means may be employed to urge the expander tool 175 through the hanger 100 such as hydraulics or any other means known in the art. Furthermore, the expander tool 175 may be disposed in the hanger 100 in any orientation, such as in a downward orientation as shown for a top down expansion or in an upward orientation for a bottom up expansion. Additionally, a rotary expandable tool (not shown) may be employed. The rotary expandable tool moves between a first smaller diameter and a second larger diameter, thereby allowing for both a top down expansion and a bottom up expansion depending on the directional axial movement of the rotary expandable tool.

As shown in FIG. 3, the expander tool 175 has expanded a portion of the hanger 100 toward the casing 60. During expansion of the hanger 100, the seal ring 135 moves into contact with the casing 60 to create a seal between the hanger 100 and the casing 60. As the seal ring 135 contacts the casing 60, the seal ring 135 changes configuration and occupies a portion of the volume gap 145. In the embodiment shown, the volume gap 145 is located on the side of the seal assembly 150 which is the first portion to be expanded by the expander tool 175. The location of the volume gap 145 in the seal assembly 150 allows the seal ring 135 to change position (or reconfigure) within the gland 140 during the expansion operation. Additionally, the volume of the volume gap 145 may change during the expansion operation. As shown in FIG. 4B, the expander tool 175 is removed from the hanger 100 after the hanger 100 is expanded into contact with the casing 60.

Figure 6:
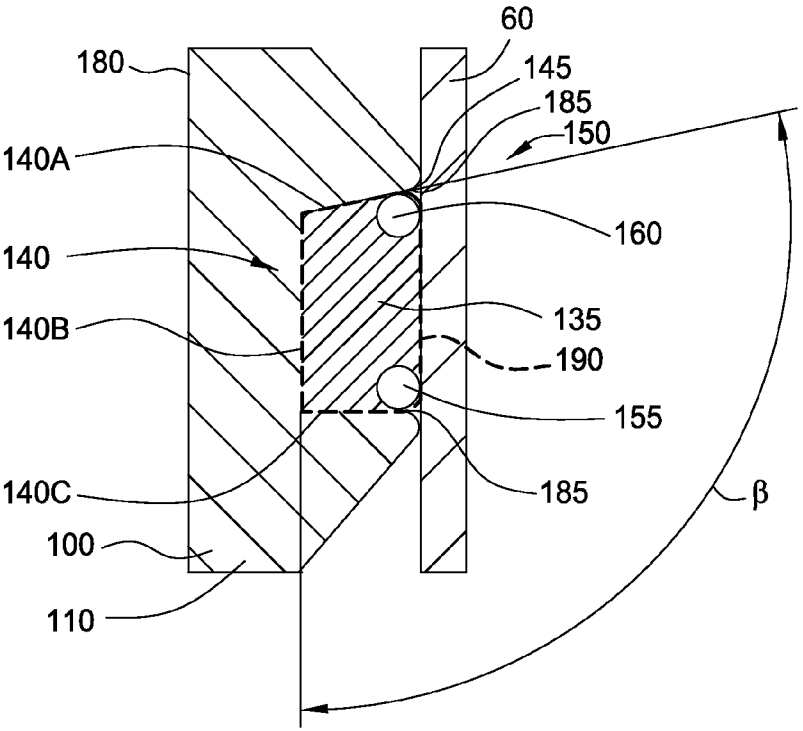
FIG. 6 illustrates an enlarged view of the seal assembly after expansion.

The seal ring 135 changes configuration during the expansion operation. As shown in FIG. 5, the seal ring 135 has a volume which is represented by reference number 190. Prior to expansion, a portion of the volume 190 of the seal ring 135 is positioned within the gland 140 and another portion of the volume 190 of the seal ring 135 extends outside of the gland 140 (beyond line 195). After expansion, the volume 190 of the seal ring 135 is repositioned such that the seal ring 135 moves into the volume gap 145 as shown in FIG. 6. In other words, the volume 190 of the seal ring 135 is substantially the same prior to expansion and after expansion. However, the volume of the seal ring 135 within the gland 140 increases after the expansion operation because the portion of the volume 190 of the seal ring 135 that was outside of the gland 140 (beyond line 195) has moved within the gland 140 (compare FIGS. 5 and 6). Thus, the volume 190 of the seal ring 135 is substantially within the gland 140 after the expansion operation. In an alternative embodiment, the seal ring 135 does not extend outside of the gland 140 (beyond line 195) prior to expansion. The volume 190 of the seal ring 135 is repositioned during the expansion operation such that the seal ring 135 moves into the volume gap 145. The volume 190 of the seal ring 135 is substantially the same prior to expansion and after expansion. In this manner, the seal ring 135 changes configuration during the expansion operation and occupies (or closes) the volume gap 145.

The volume of the gland 140 and/or the volume gap 145 may decrease as the seal assembly 150 is expanded radially outward during the expansion operation. As set forth herein, the angle $\alpha$ (FIG. 5) decreases to the angle $\beta$ (FIG. 6), which causes the size of the volume gap 145 to decrease. The height of the gland 140 may also become smaller, which causes the volume of the gland 140 to decrease. As such, the combination of the change in configuration of the seal ring 135 and the change of configuration of the volume of the gland 140 (and/or the volume gap 145) allows the seal ring 135 to create a seal with the casing 60. In one embodiment, the volume of the gland 140 (including the volume gap 145) after the expansion operation may be substantially the same as the volume 190 of the seal ring 135. In another embodiment, the volume of the gland 140 (including the volume gap 145) after the expansion operation may be equal to the volume 190 of the seal ring 135 or may be greater than the volume 190 of the seal ring 135.

As shown in FIG. 6, the seal bands 155, 160 in the seal ring 135 are urged toward an interface 185 between the seal assembly 150 and the casing 60 during the expansion operation. The volume gap 145 permits the seal ring 135 to move within the gland 140 and position the seal bands 155, 160 at a location proximate the interface 185. In this position, the seal bands 155, 160 substantially prevent the extrusion of the seal ring 135 past the interface 185. In other words, the seal bands 155, 160 expand radially outward with the hanger 100 and block the elastomeric material of the seal ring 135 from flowing through the interface 185 between the seal assembly 150 and the casing 60. In one embodiment, the seal bands 155, 160 are springs, such as toroidal coil springs, which expand radially outward due to the expansion of the hanger 100. As the spring expands radially outward, the coils of spring act as a barrier to the flow of the elastomeric material of the seal ring 135. In this manner, the seal bands 155, 160 in the seal ring 135 act as an anti-extrusion device or an extrusion barrier.

There are several benefits of the extrusion barrier created by the seal bands 155, 160. One benefit of the extrusion barrier would be that the outer surface of the seal ring 135 in contact with the casing 60 is limited to a region between the seal bands 155, 160, which allows for a high-pressure seal to be created between the seal assembly 150 and the casing 60. In one embodiment, the seal assembly 150 may create a high-pressure seal in the range of 12,000 to 14,000 psi. A further benefit of the extrusion barrier would be that the seal assembly 150 is capable of creating a seal with a surrounding casing that may have a range of inner diameters due to API tolerances. Another benefit would be that the extrusion barrier created by the seal bands 155, 160 may prevent erosion of the seal ring 135 after the hanger 100 has been expanded. The erosion of the seal ring 135 could eventually lead to a malfunction of the seal assembly 150. A further benefit is that the seal bands 155, 160 act as an extrusion barrier after expansion of the expandable hanger 100. More specifically, the extrusion barrier created by the seal bands 155, 160 may prevent extrusion of the seal ring 135 when the gap between the expandable hanger 100 and the casing 60 is increased due to downhole pressure. In other words, the seal bands 155, 160 bridge the gap, and the net extrusion gap between coils of the seal bands 155, 160 grows considerably less as compared to an annular gap that is formed when a seal ring does not include the seal bands. For instance, the annular gap (without seal bands) may be on the order of 0.030" radial as compared to the net extrusion gap between coils of the seal bands 155, 160 which may be on the order of 0.001/0.003".

Figure 7:
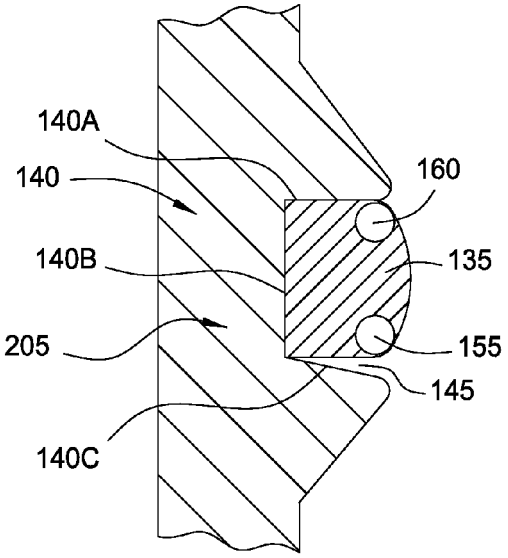
FIGS. 7-10 illustrate views of different embodiments of the seal assembly.

FIGS. 7-10 illustrate views of different embodiments of the seal assembly. For convenience, the components in the seal assembly in FIGS. 7-10 that are similar to the components in the seal assembly 150 will be labeled with the same number indicator. FIG. 7 illustrates a view of a seal assembly 205 that includes the volume gap 145 on a lower portion of the seal assembly 205. As shown, the volume gap 145 is between the side 140C and the seal ring 135. In this embodiment, a bonding material, such as glue, may be applied to sides 140A, 140B during the fabrication stage of the seal assembly 205 to attach the seal ring 135 in the gland 140. Similar to other embodiments, the seal ring 135 will be reconfigured and occupy at least a portion of the volume gap 145 upon expansion of the seal assembly 205.

Figure 8:
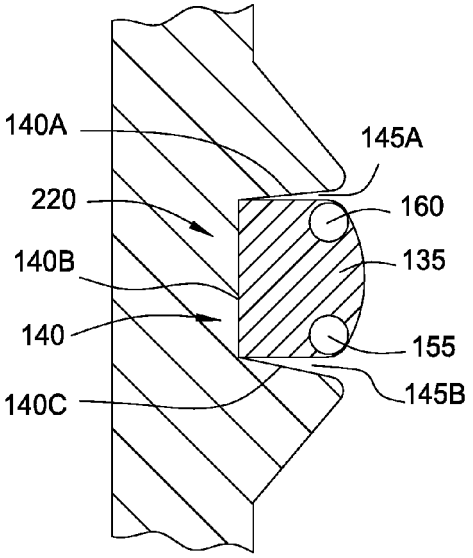

FIG. 8 illustrates a view of a seal assembly 220 that includes the volume gap 145 on a lower portion and an upper portion of the seal assembly 220. As shown, a first volume gap 145A is between the side 140A and the seal ring 135 and a second volume gap 145B is between the side 140C and the seal ring 135. The first volume gap 145A and the second volume gap 145B may be equal or may be different. In this embodiment, the bonding material may be applied to the side 140B during the fabrication stage of the seal assembly 220 to attach the seal ring 135 in the gland 140. Similar to other embodiments, the seal ring 135 will be reconfigured and occupy at least a portion of the first volume gap 145A and at least a portion of the second volume gap 1458 upon expansion of the seal assembly 220.

Figure 9:
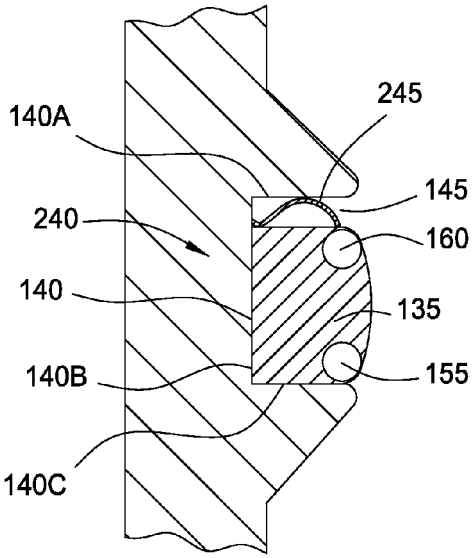

FIG. 9 illustrates a view of a seal assembly 240 that includes the volume gap 145 with a biasing member 245. As shown, the side 140A of the gland 140 is perpendicular to the side 140B. The biasing member 245, such as a spring washer or a crush ring, is disposed in the volume gap 145 between the side 140A and the seal ring 135. The biasing member 245 may be used to maintain the position of the seal ring 135 in the gland 140. In addition to seal band 160, the biasing member 245 may also act as an extrusion barrier upon expansion of the seal assembly 240. During the expansion operation, the seal ring 135 will be reconfigured in the gland 140 and compress the biasing member 245. Additionally, in this embodiment, the bonding material may be used on sides 140B, 140C during the fabrication stage of the seal assembly 240 to attach the seal ring 135 in the gland 140.

Figure 10:
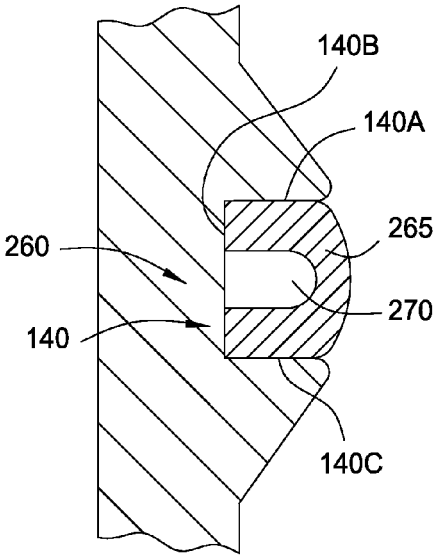

FIG. 10 illustrates a view of a seal assembly 260 that includes a volume gap 270 in a portion of a seal ring 265. In this embodiment, the bonding material may be used on sides 140A, 140B, 140C during the fabrication stage of the seal assembly 260 to attach the seal ring 265 in the gland 140. Similar to other embodiments, the seal ring 265 will be reconfigured upon expansion of the seal assembly 260. However, in this embodiment, the volume gap 270 in the portion of the seal ring 265 will be close or decrease in size when the seal ring 265 is urged into contact with the surrounding casing. In another embodiment, the seal ring 265 may include seal bands (not shown) embedded in the seal ring 265 similar to seal bands 155, 160. In a further embodiment, an equalization vent (not shown) may be formed in the seal ring 265 to provide communication between the volume gap 270 and an external portion of the seal ring 265. The equalization vent may be used to prevent the collapse of the seal ring 265 due to exposure of hydrostatic pressure.

Figure 11:
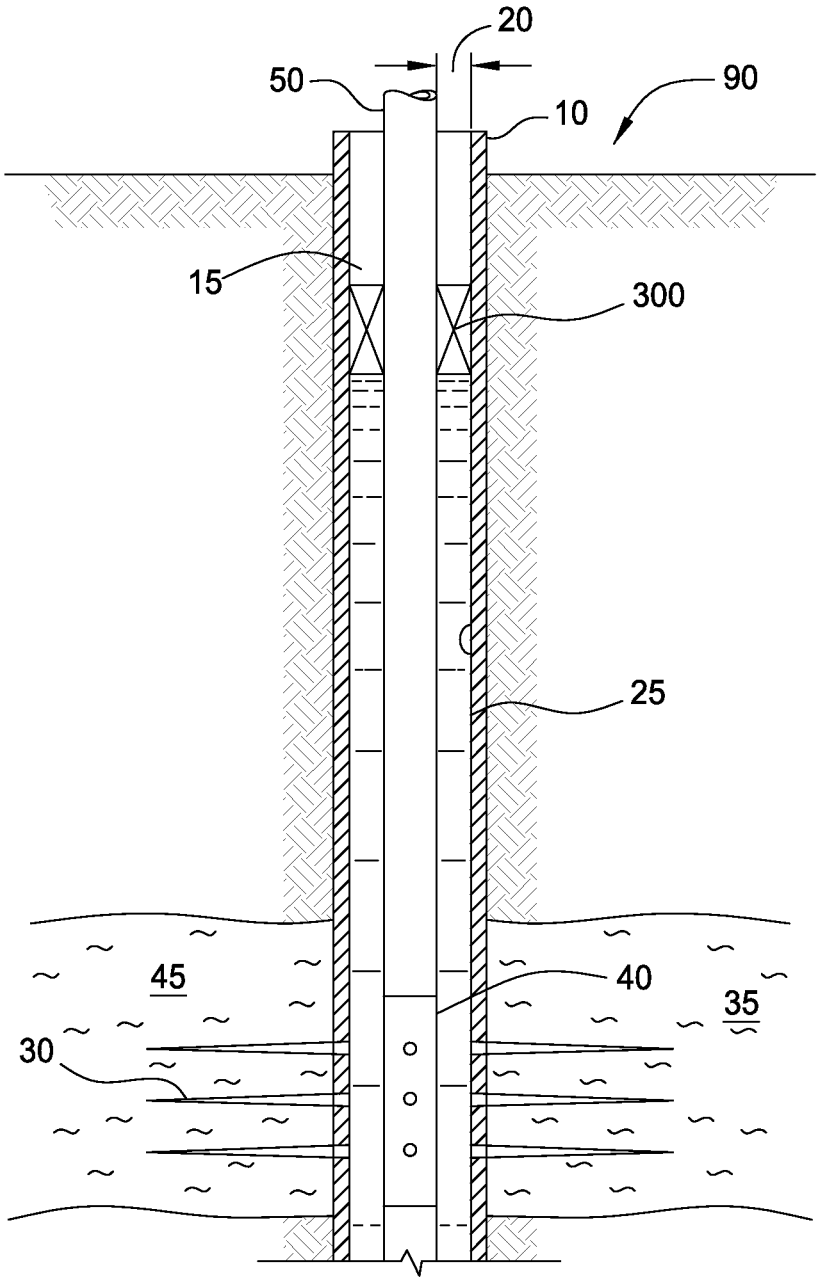
FIG. 11 illustrates a view of a downhole tool in a well.

FIG. 11 illustrates a view of a typical subterranean hydrocarbon well 90 that defines a vertical wellbore 25. The well 90 has multiple hydrocarbon-bearing formations, such as oil-bearing formation 45 and/or gas-bearing formations (not shown). After the wellbore 25 is formed and lined with casing 10, a tubing string 50 is run into an opening 15 formed by the casing 10 to provide a pathway for hydrocarbons to the surface of the well 90. Hydrocarbons may be recovered by forming perforations 30 in the formations 45 to allow hydrocarbons to enter the casing opening 15. In the illustrative embodiment, the perforations 30 are formed by operating a perforation gun 40, which is a component of the tubing string 50. The perforating gun 40 is used to perforate the casing 10 to allow the hydrocarbons trapped in the formations 45 to flow to the surface of the well 90.

The tubing string 50 also carries a downhole tool 300, such as a packer, a bridge plug or any other downhole tool used to seal a desired location in a wellbore. Although generically shown as a singular element, the downhole tool 300 may be an assembly of components. Generally, the downhole tool 300 may be operated by hydraulic or mechanical means and is used to form a seal at a desired location in the wellbore 25. The downhole tool 300 may seal, for example, an annular space 20 formed between a production tubing 50 and the wellbore casing 106. Alternatively, the downhole tool 300 may seal an annular space between the outside of a tubular and an unlined wellbore. Common uses of the downhole tool 300 include protection of the casing 10 from pressure and corrosive fluids; isolation of casing leaks, squeezed perforations, or multiple producing intervals; and holding of treating fluids, heavy fluids or kill fluids. However, these uses for the downhole tool 300 are merely illustrative, and application of the downhole tool 300 is not limited to only these uses. The downhole tool 300 may also be used with a conventional liner hanger (not shown) in a liner assembly. Typically, the downhole tool 300 would be positioned in the liner assembly proximate the conventional liner hanger. In one embodiment, the downhole tool assembly is positioned above the conventional liner hanger. After the conventional liner hanger is set inside the wellbore casing, a cementation operation may be done to secure the liner within the wellbore. Thereafter, the downhole tool 300 may be activated to seal an annular space formed between liner assembly and the wellbore casing.

Figure 12:
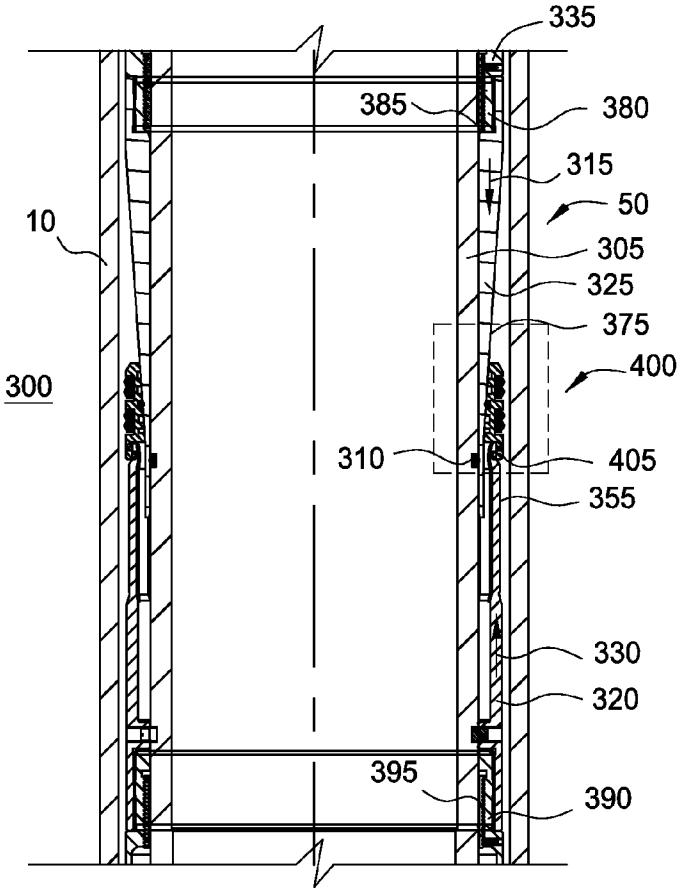
FIG. 12 illustrates a view of the downhole tool in a run-in position.

FIG. 12 illustrates the downhole tool 300 in a run-in (unset) position. As shown in FIG. 12, the tubing string 50 includes a mandrel 305 which defines an inner diameter of the depicted portion of the tubing string 50. An actuator sleeve 335 is slidably disposed about at least a portion of the mandrel 305. The mandrel 305 and the actuator sleeve 335 define a sealed interface by the provision of an O-ring (not shown) carried on an outer diameter of the mandrel 305. A terminal end of the actuator sleeve 335 is shouldered against a wedge member 325. The wedge member 325 is generally cylindrical and slidably disposed about the mandrel 305. An O-ring 310 seal is disposed between the mandrel 305 and the wedge member 325 to form a sealed interface therebetween. The seal 310 is carried on the inner surface of the wedge member 325; however, the seal 310 may also be carried on the outer surface of the mandrel 305. In one embodiment, the seal 310 includes seal bands (i.e., anti-extrusion bands) in a similar manner as sealing element 450A-B. Further, a volume gap may be defined between the seal 310 and a portion of the wedge member 325 in a similar manner as volume gap 470A-B.

The downhole tool 300 includes a locking mechanism which allows the wedge member 325 to travel in one direction and prevents travel in the opposite direction. In one embodiment, the locking mechanism is implemented as a ratchet ring 380 disposed on a ratchet surface 385 of the mandrel 305. The ratchet ring 380 is recessed into, and carried by, the wedge member 325. In this case, the interface of the ratchet ring 380 and the ratchet surface 385 allows the wedge member 325 to travel only in the direction of the arrow 315.

A portion of the wedge member 325 forms an outer tapered surface 375. In operation, the tapered surface 375 forms an inclined glide surface for a packing element 400. Accordingly, the wedge member 325 is shown disposed between the mandrel 305 and packing element 400, where the packing element 400 is disposed on the tapered surface 375. In the depicted run-in position, the packing element 400 is located at a tip of the wedge member 325, the tip defining a relatively smaller outer diameter with respect to the other end of the tapered surface 375.

The packing element 400 is held in place by a retaining sleeve 320. The packing element 400 may be coupled to the retaining sleeve 320 by a variety of locking interfaces. In one embodiment, the retaining sleeve 320 includes a plurality of collet fingers 355. The terminal ends of the collet fingers 355 are interlocked with an annular lip 405 of the packing element 400. The collet fingers 355 may be biased in a radial direction. For example, it is contemplated that the collet fingers 355 have outward radial bias urging the collet fingers 355 into a flared or straighter position. However, in this case the collet fingers 355 do not provide a sufficient force to cause expansion of the packing element 400.

The downhole tool 300 includes a self-adjusting locking mechanism which allows the retaining sleeve 320 to travel in one direction and prevents travel in the opposite direction. The locking mechanism is implemented as a ratchet ring 390 disposed on a ratchet surface 395 of the mandrel 305. The ratchet ring 390 is recessed into, and carried by, the retaining sleeve 320. In this case, the interface of the ratchet ring 390 and the ratchet surface 395 allows the retaining sleeve 320 to travel only in the direction of the arrow 330, relative to the mandrel 305. As will be described in more detail below, this self-adjusting locking mechanism ensures that a sufficient seal is maintained by the packing element 400 despite counter-forces acting to subvert the integrity of the seal.

Figure 14:
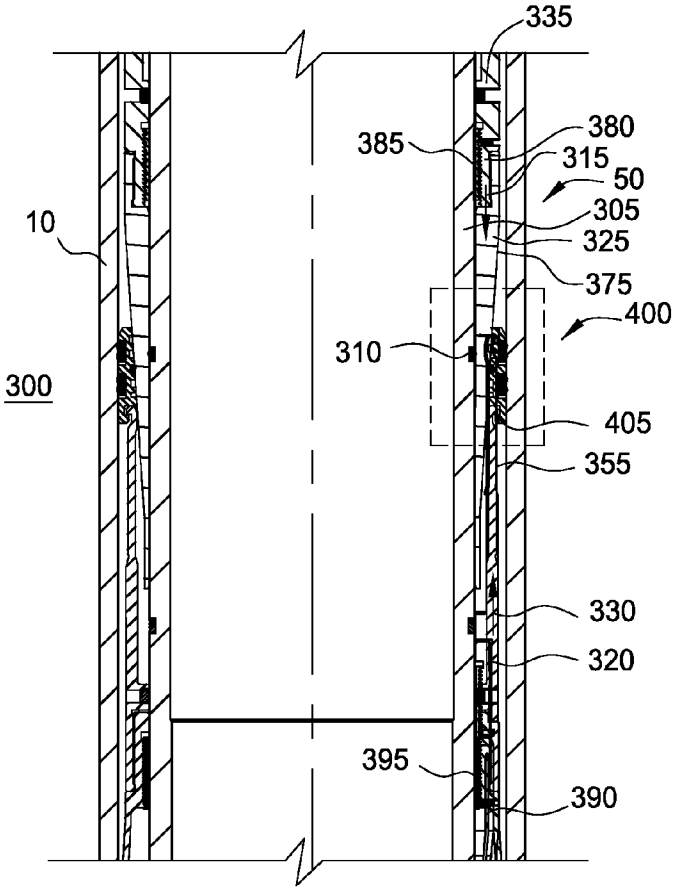
FIG. 14 illustrates a view of the downhole tool in an expanded and operating position.

In operation, the downhole tool 300 is run into a wellbore in the run-in position shown in FIG. 12. To set the downhole tool 300, the actuator sleeve 335 is driven axially in the direction of the arrow 315. The axial movement of the actuator sleeve 335 may be caused by, for example, applied mechanical force from the weight of a tubing string or hydraulic pressure acting on a piston. The actuator sleeve 335, in turn, engages the wedge member 325 and drives the wedge member 325 axially along the outer surface of the mandrel 305. The ratchet ring 380 and the ratchet surface 385 ensure that the wedge member 325 travels only in the direction of the arrow 315. With continuing travel over the mandrel 305, the wedge member 325 is driven underneath the packing element 400. The packing element 400 is prevented from moving with respect to the wedge member 325 by the provision of the ratchet ring 390 and the ratchet surface 395. As a result, the packing element 400 is forced to slide over the tapered surface 375. The positive inclination of the tapered surface 375 urges the packing element 400 into a diametrically expanded position. The set position of the downhole tool 300 is shown in FIG. 14. In the set position, the packing element 400 rests at an upper end of the tapered surface 375 and is urged into contact with the casing 10 to form a fluid-tight seal which is formed in part by a metal-to-elastomer seal and a metal-to-metal contact. More generally, the metal may be any non-elastomer.

Figure 15:
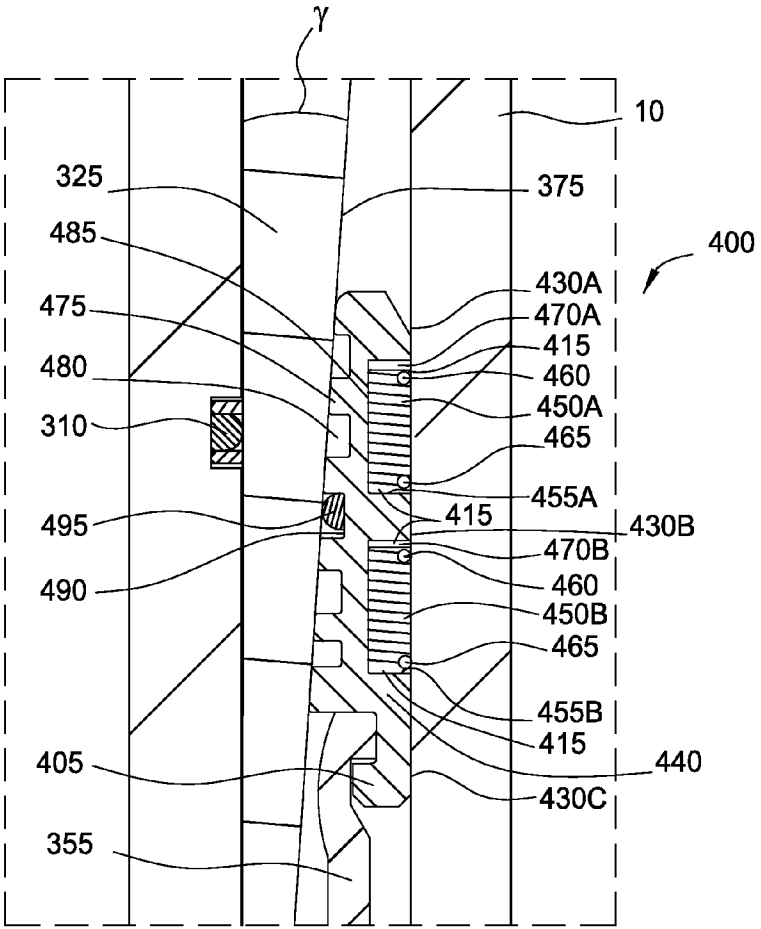
FIG. 15 illustrates an enlarged view of the packing element in the downhole tool.

In the set position, the collet fingers 355 are flared radially outwardly but remain interlocked with the lip 405 formed on the packing element 400. This coupling ties the position of the retaining sleeve 320 and ratchet ring 390 to the axial position of packing element 400. This allows the packing element 400 to move up the wedge member 325 in response to increased pressure from below, maintaining its tight interface with the casing inner diameter, but prevents relative movement of the packing element 400 in the opposite direction (shown by the arrow 315). The pressure from below the downhole tool 300 may act to diminish the integrity of the seal formed by the packing element 400 since the interface of the packing element 400 with the casing 10 and wedge member 325 will loosen due to pressure swelling the casing 10 and likewise acting to collapse the wedge member 325 from under the packing element 400. One embodiment of the downhole tool 300 counteracts such an undesirable effect by the provision of the self-adjusting locking mechanism implemented by the ratchet ring 390 and ratchet surface 395. In particular, the retaining sleeve 320 is permitted to travel up the mandrel 305 in the direction of the arrow 330 in response to a motivating force acting on the packing element 400, as shown in FIG. 15. However, the locking mechanism prevents the retaining sleeve 320 from traveling in the opposite direction (i.e., in the direction of arrow 315), thereby ensuring that the seal does not move with respect to the casing 10 when pressure is acting from above, thus reducing wear on the packing element 400.

Figure 13:
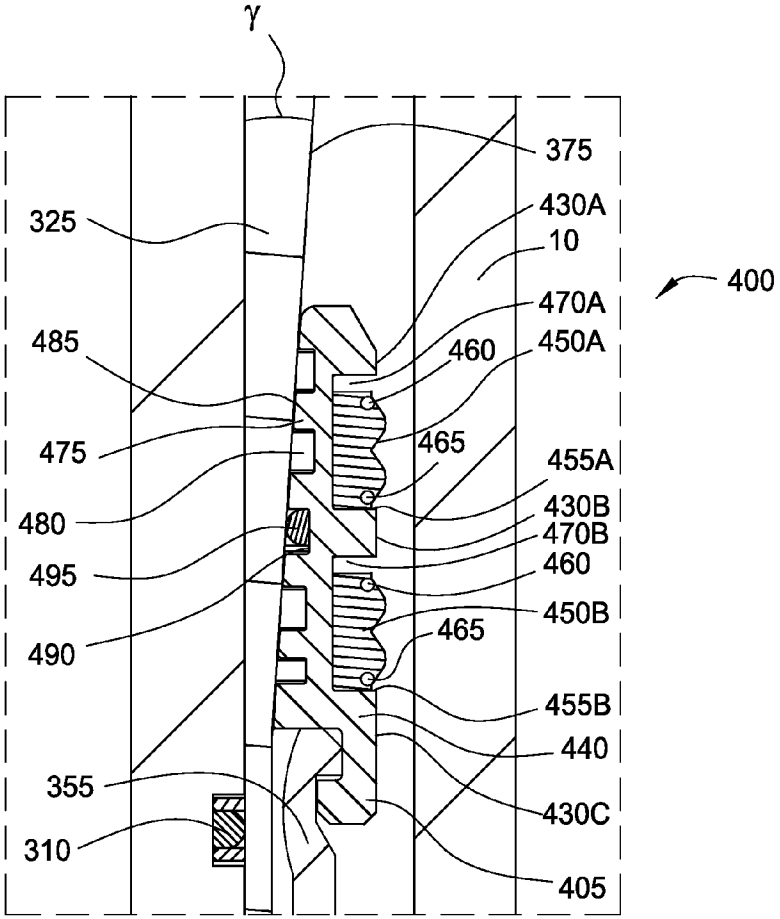
FIG. 13 illustrates an enlarged view of a packing element in the downhole tool.

FIG. 13 illustrates an enlarged view of the packing element 400 in the unset position. As such, the packing element 400 rests on the diametrically smaller end of the tapered surface 375. The packing element 400 includes a tubular body 440 which is an annular member. The tubular body 440 includes a substantially smooth outer surface at its outer diameter, and defining a shaped inner diameter. In this context, a person skilled in the art will recognize that a desired smoothness of the outer surface is determined according to the particular environment and circumstances in which the packing element 400 is set. For example, the expected pressures to be withstood by the resulting seal formed by the packing element 400 will affect the smoothness of the outer surface. In one embodiment, the tubular body 440 may include a portion of the outer surface that includes knurling or a rough surface area which may be used as an anchor portion when the packing element 400 is set.

To form a seal with respect to the casing 10, the packing element 400 includes one or more sealing elements 450A-B. The sealing elements 450A-B may be elastomer bands. In another embodiment, the sealing elements 450A-B are swelling elastomers. The sealing elements 450A-B are preferably secured in grooves 455A-B formed in the tubular body 440. For example, the sealing elements 450A-B may be bonded to the grooves 455A-B by a bonding material during the fabrication stage of the packing element 400. Each groove 455A-B includes a volume gap 470A-B. As shown in FIG. 13, the volume gap 470A-B is located on a lower portion of the groove 455A-B. In other embodiments, the volume gap 470A-B may be located at different positions and in different configurations in the groove 455A-B (see volume gap in FIGS. 5-10, for example). Generally, the volume gap 470A-B is used to substantially prevent distortion of the sealing element 450A-B upon expansion of the packing element 400. The size of the volume gap 470A-B may vary depending on the configuration of the groove 455A-B. In one embodiment, the groove 455A-B has 3-5% more volume due to the volume gap 470A-B than a groove without a volume gap.

Each sealing element 450A-B includes a first seal band 460 and a second seal band 465. The seal bands 460, 465 are embedded in the sealing element 450A-B. In one embodiment, the seal bands 460, 465 are springs. The seal bands 460, 465 are used to limit the extrusion of the sealing element 450A-B upon expansion of the packing element 400.

The portions of the outer surface between the sealing elements 450A-B form non-elastomer sealing surfaces 430A-C. The non-elastomer sealing surfaces 430A-C may include grip members, such as carbide inserts, knurling or a rough surface which allows the non-elastomer sealing surfaces 430A-C to seal and act as an anchor upon expansion of the packing element 400. For instance, the anchor portion (i.e., rough surface on the surfaces 430A-C) would contact and engage with the surrounding casing 10 when the packing element 400 is set, as shown in FIG. 15. The anchor portion may be used to hold the packing sealing elements 450A-B in place by preventing movement of the packing element 400. In other words, the anchor portion ensures that the packing sealing elements 450A-B do not move with respect to the casing 10 when subjected to high differential pressure, thus allowing the packing sealing elements 450A-B to maintain the sealing relationship with the casing 10 while at the same time reducing wear on the packing element 400. In one embodiment, the surfaces 430A-C are induction hardened or similar means so that the surfaces 430A-C penetrate an inner surface of the casing 10 to provide a robust anchoring means when the packing element 400 is activated. In this manner, the anchor portion may be used to help resist axial movement of the packing sealing elements 450A-B relative to the casing 10 when the packing sealing elements 450A-B are subjected to high differential pressure.

The anchor portion (i.e., rough surface on the surfaces 430A-C) may be used in place of a gripping member (not shown) in the downhole tool 300. Rather than having a separate gripping member, such as slips, on the downhole tool 300, the anchor portion may be configured to hold the downhole tool 300 within the casing 10, thus reducing the number of components in the downhole tool 300 and reducing the overall length of the downhole tool 300. Other benefits of using the anchor portion (rather than separate slips) would be that the overall stroke length of the downhole tool 300 would be reduced; elimination of potential leak paths and manufacturing costs would be reduced without compromising performance. The length and/or the size of the surfaces 430A-C may be arranged such that when the packing element 400 is set, a sufficient gripping force is created between the anchor portion and the surrounding casing 10 to support the downhole tool 300 within the wellbore. The surfaces 430A-C may also be induction hardened so that the surfaces 430A-C penetrate the casing 10 surface to provide a robust anchoring means upon activation of the packing element 400. As discussed herein in relation to FIGS. 13-15, the wedge member 325 slides relative to the mandrel 305 to a position under the tubular body 440 to expand the packing element 400 radially outward into contact with the casing 10. In another embodiment, the wedge member 325 and the mandrel 305 are formed as a single member (not shown) with a tapered surface, thus eliminating the need for the seal 310 and creating a thicker portion of the downhole tool 300 proximate the packing element 400. Further, the tubular body 440 could be configured to move along the tapered surface of the single member to expand the packing element 400 radially outward into contact with the casing 10.

The number and size of the sealing elements 450A-B define the surface area of the non-elastomer sealing surfaces 430A-C. It is to be noted that any number of sealing elements 450A-B and non-elastomer sealing surfaces 430A-C may be provided. The packing element 400 shown includes two sealing elements 450A-B and defining three non-elastomer sealing surfaces 430A-C. In general, a relatively narrow width of each non-elastomer sealing surface 430A-C is preferred in order to achieve a sufficient contact force between the surfaces and the casing 10.

The shaped inner diameter of the tubular body 440 is defined by a plurality of ribs 475 separated by a plurality of cutouts 480 (e.g., voids). The cutouts 480 allow a degree of deformation of the tubular body 440 when the packing element 400 is placed into a sealed position. Further, the cutouts 480 aid in reducing the amount of setting force required to expand the packing element 400 into the sealed position. In other words, by removing material (e.g., cutouts 480) of the tubular body 440, the force required to expand the packing element 400 is reduced. In one embodiment, the volume of the cutouts 480 (voids) is between 25-40% of the volume of the tubular body 440. The ribs 475 are annular members integrally formed as part of the tubular body 440. Each rib 475 forms an actuator-contact surface 485 at the inner diameter of the tubular body 340, where the rib 475 is disposed on the tapered surface 375. In an illustrative embodiment, the tapered surface 375 has an angle γ between about 2 degrees and about 6 degrees. Accordingly, the shaped inner diameter defined by the actuator-contact surfaces 485 may have a substantially similar taper angle.

The tubular body 440 further includes an O-ring seal 495 in cutout 490. The seal 495 is configured to form a fluid-tight seal with respect to the outer tapered surface 375 of the wedge member 325. In one embodiment, the seal 495 includes seal bands (i.e., anti-extrusion bands) in a similar manner as sealing element 450A-B. Further, a volume gap may be defined between the seal 495 and a portion of the cutout 490 in a similar manner as volume gap 470A-B. It is noted that in another embodiment, the cutouts 480 may also, or alternatively, carry seals at their respective inner diameters.

In FIG. 15, the packing element 400 is shown in the sealed (set) position, corresponding to FIG. 14. During expansion of the packing element 400, the sealing element 450A-B moves into contact with the casing 10 to create a seal between the packing element 400 and the casing 10. As the sealing element 450A-B contacts the casing 10, the sealing element 450A-B changes configuration and occupies a portion of the volume gap 470A-B. In the embodiment shown, the volume gap 470A-B is located on the side of the packing element 400, which is the last portion to be expanded by the wedge member 325. The location of the volume gap 470A-B in the packing element 400 allows the sealing element 450A-B to change position (or reconfigure) within the groove 455A-B during the expansion operation. Additionally, the volume of the volume gap 470A-B may change during the expansion operation. In one embodiment, the volume of the volume gap 470A-B may be reduced by 5-15% during the expansion operation.

During the expansion operation, the seal bands 460, 465 in the sealing element 450A-B are urged toward an interface 415 between the packing element 400 and the casing 10, as shown in FIG. 6. The volume gap 470A-B permits the sealing element 450A-B to move within the groove 455A-B and position the seal bands 460, 465 at a location proximate the interface 415. In comparing the volume gap 470A-B prior to expansion (FIG. 13) and after expansion (FIG. 15), a small volume gap remains after the expansion operation. It is to be noted that the small volume gap is optional. In other words, there may not be a small volume gap (see volume gap 470A-B on FIG. 15) after the expansion operation.

The seal bands 460, 465 are configured to substantially prevent the extrusion of the sealing element 450A-B past the interface 415. In other words, the seal bands 460, 465 expand radially outward with the packing element 400 and block the elastomeric material of the sealing element 450A-B from flowing through the interface 415 between the packing element 400 and the casing 10. In one embodiment, the seal bands 460, 465 are springs, such as toroidal coil springs, which expand radially outward due to the expansion of the packing element 400. As the spring expands radially outward during the expansion operation, the coils of spring act as a barrier to the flow of the elastomeric material of the sealing element 450A-B. After the expansion operation, the seal bands 460, 465 may prevent extrusion of the sealing element 450A-B when a gap between the packing element 400 and the casing 10 is increased due to downhole pressure. In other words, the seal bands 460, 465 bridge the gap between the packing element 400 and the casing 10 and prevent extrusion of the sealing element 450A-B. In this manner, the seal bands 460, 465 in the sealing element 450A-B act as an anti-extrusion device or an extrusion barrier during the expansion operation and after the expansion operation.

There are several benefits of the extrusion barrier created by the seal bands 460, 465. One benefit of the extrusion barrier would be that the outer surface of the sealing element 450A-B in contact with the casing 10 is limited to a region between the seal bands 460, 465, which allows for a high pressure seal to be created between the packing element 400 and the casing 10. In one embodiment, the packing element 400 may create a high-pressure seal in the range of 12,000 to 15,000 psi. A further benefit of the extrusion barrier would be that the packing element 400 is capable of creating a seal with a surrounding casing that may have a range of inner diameters due to API tolerances. Another benefit would be that the extrusion barrier created by the seal bands 460, 465 may prevent erosion of the sealing element 450A-B after the packing element 400 has been expanded. The erosion of the sealing element 450A-B could eventually lead to a malfunction of the packing element 400.

The packing element 400 rests at the diametrically enlarged end of the tapered surface 375 and is sandwiched between the wedge member 325 and the casing 10. The dimensions of the downhole tool 300 are preferably such that the packing element 400 is fully engaged with the casing 10, before the tubular body 440 reaches the end of the tapered surface 375. Note that in the sealed position, the sealing elements 450A-B and the non-elastomer sealing surfaces 430A-C have been expanded into contact with the casing 10.

As such, it is clear that the tubular body 440 has undergone a degree of deformation. The process of deformation may occur, at least in part, as the packing element 400 slides up the tapered surface 375, prior to making contact with the inner diameter of the casing 10. Additionally or alternatively, deformation may occur as a result of contact with the inner diameter of the casing 106. In any case, the process of deformation causes the sealing elements 450A-B and the non-elastomer sealing surfaces 430A-C to contact the inner diameter of the casing 10 in the sealed position. In addition, the non-elastomeric backup seals prevent extrusion of the sealing elements 450A-B.

Figure 16:
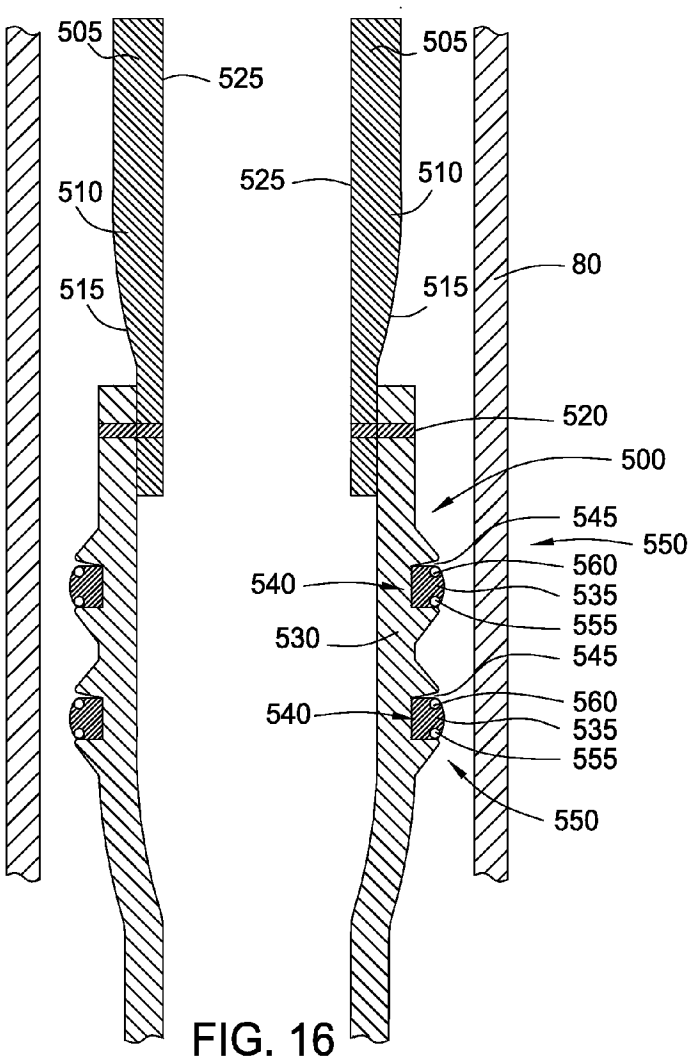
FIG. 16 illustrates a view of a hanger assembly in an unset position.

FIG. 16 illustrates a hanger assembly 500 in an unset position. At the stage of completion shown in FIG. 16, a wellbore has been lined with a string of casing 80. Thereafter, the hanger assembly 500 is positioned within the casing 80. The hanger assembly 500 includes a hanger 530, which is an annular member. The hanger assembly further includes an expander sleeve 510. Typically, the hanger assembly 500 is lowered into the wellbore by a running tool disposed at the lower end of a work string (not shown).

The hanger assembly 500 includes the hanger 530 of this present invention. The hanger 530 may be used to attach or hang liners from an internal wall of the casing 80. The hanger 530 may also be used as a patch to seal an annular space formed between hanger assembly 500 and the wellbore casing 80 or an annular space between hanger assembly 500 and an unlined wellbore. The hanger 530 optionally includes grip members, such as tungsten carbide inserts or slips. The grip members may be disposed on an outer surface of the hanger 530. The grip members may be used to grip an inner surface of the casing 80 upon expansion of the hanger 530.

As shown in FIG. 16, the hanger 530 includes a plurality of seal assemblies 550 disposed on the outer surface of a tubular body of the hanger 530. The plurality of seal assemblies 550 are circumferentially spaced around the hanger 530 to create a seal between hanger assembly 500 and the casing 80. Each seal assembly 550 includes a seal ring 535 disposed in a gland 540. A bonding material, such as glue (or other attachment means), may be used on selective sides of the gland 540 to attach the seal ring 535 in the gland 540. Bonding the seal ring 535 in the gland 540 is useful to prevent the seal ring 535 from becoming unstable and swab off when the hanger 530 is positioned in the casing 80 and prior to expansion of the hanger 530. Bonding the seal ring 535 in the gland 540 is also useful to resist circulation flow swab off as installation of liners typically require fluid displacements prior to sealing and anchoring of the hanger assembly 500.

The side of the gland 540 creates a volume gap 545 between the seal ring 535 and the gland 540. As set forth herein, the volume gap 545 is generally used to minimize distortion of the seal ring 535 upon expansion of the hanger 530. The volume gap 545 may be created in any configuration (see FIGS. 7-10, for example) without departing from principles of the present invention. Additionally, the size of the volume gap 545 may vary depending on the configuration of the gland 540. The seal ring 535 includes a first seal band 555 and a second seal band 560. The seal bands 555, 560 are embedded in opposite sides of the seal ring 535. The seal bands 555, 560 are used to limit the extrusion of the seal ring 535 during and after expansion of the seal assembly 550.

The hanger assembly 500 includes the expander sleeve 510 which is used to expand the hanger 530. In one embodiment, the expander sleeve 510 is attached to the hanger 530 by an optional releasable connection member 520, such as a shear pin. The expander sleeve 510 includes a tapered outer surface 515 and a bore 525. The expander sleeve 510 further includes an end portion 505 that is configured to interact with an actuator member (not shown). The expander sleeve 510 optionally includes a self-adjusting locking mechanism (not shown) which allows the expander sleeve 510 to travel in one direction and prevents travel in the opposite direction.

To set the hanger assembly 500, the actuator member is driven axially in a direction toward the hanger 530. The axial movement of the actuator member may be caused by, for example, applied mechanical force from the weight of a tubing string or hydraulic pressure acting on a piston. The actuator member, in turn, engages the end portion 505 of the expander sleeve 510 in order to move the expander sleeve 510 axially toward the hanger 530. At a predetermined force, the optional releasable connection member 520 is disengaged, which allows the expander sleeve 510 to move relative to the hanger 530. The hanger 530 is prevented from moving with respect to the wedge expander sleeve 510. As the tapered outer surface 515 of expander sleeve 510 engages the inner surface of the hanger 530, the hanger 530 is moved into a diametrically expanded position.

Figure 17:
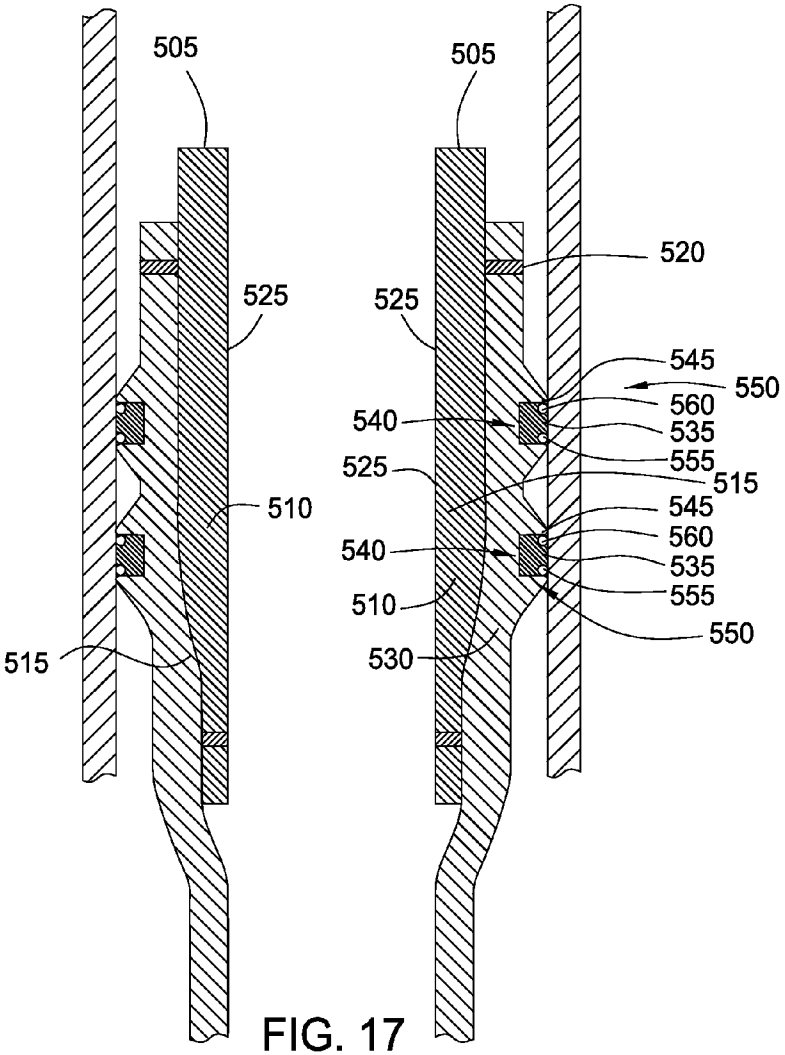
FIG. 17 illustrates a view of the hanger assembly in a set position.

The set position of the hanger assembly 500 is shown in FIG. 17. In the set position, the expander sleeve 510 is positioned inside the hanger 530. In other words, the expander sleeve 510 is not removed from the hanger 530. This arrangement may allow the expander sleeve 510 to apply a force on the hanger 530 after the expansion operation. The bore 525 of the expander sleeve 510 permits other wellbore tools to pass through the hanger assembly 500 prior to expansion of the hanger 530 and after expansion of the hanger 530. In comparing the hanger assembly 500 in the unset position (FIG. 16) and the hanger assembly 500 in the set position (FIG. 17), it is noted that the expander sleeve 510 is disposed substantially outside of the hanger 530 in the unset position and the expander sleeve 510 is disposed inside the hanger 530 in the set position. The expander sleeve 510 remains inside the hanger 530 after the expansion operation is complete. As such, the expander sleeve 510 is configured to support the hanger 530 after the expansion operation.

As shown in FIG. 17, the hanger 530 is urged into contact with the casing 80 to form a fluid-tight seal which is formed in part by a metal-to-elastomer seal and a metal-to-metal contact. More specifically, the seal ring 535 moves into contact with the casing 80 to create a seal between the hanger 530 and the casing 80. As the seal ring 535 contacts the casing 80, the seal ring 535 changes configuration and occupies a portion of the volume gap 545. In the embodiment shown, the volume gap 545 is located on the side of the seal assembly 550 which is the first portion to be expanded by the expander sleeve 510. The location of the volume gap 545 in the seal assembly 550 allows the seal ring 535 to change position (or reconfigure) within the gland 540 during the expansion operation. Additionally, the seal bands 555, 560 in the seal ring 535 are urged toward an interface between the seal assembly 550 and the casing 80 to block the elastomeric material of the seal ring 535 from flowing through the interface 585 between the seal assembly 550 and the casing 80. In one embodiment, the seal bands 555, 560 are springs, such as toroidal coil springs, which expand radially outward due to the expansion of the hanger 530. As the spring expands radially outward during the expansion operation, the coils of spring act as a barrier to the flow of the elastomeric material of the seal ring 535. In addition, after expansion of the hanger 530, the seal bands 555, 560 may prevent extrusion of the seal ring 535 when the gap between the hanger assembly 500 and the casing 80 is increased due to pressure. In other words, the seal bands 155, 160 bridge the gap, and the net extrusion gap between coils of the seal bands 155, 160 grows considerably less as compared to an annular gap that is formed when a seal ring does not include the seal bands. In this manner, the seal bands 555, 560 in the seal ring 535 act as an anti-extrusion device or an extrusion barrier during the expansion operation and after the expansion operation.

Figure 18:
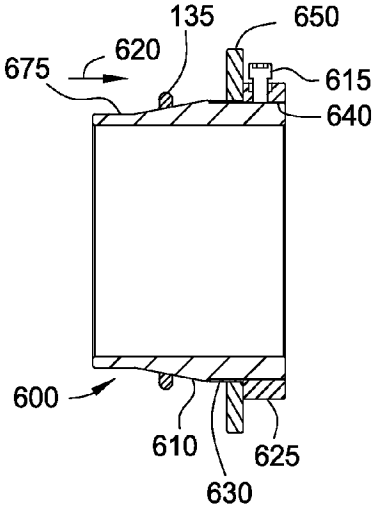
FIG. 18 illustrates a view of an installation tool used during a dry seal stretch operation.

FIG. 18 illustrates a view of an installation tool 600 for use in a dry seal stretch operation. The seal ring 135 is installed in the gland 140 during the fabrication process of the hanger 100 by the dry seal stretch operation. The installation tool 600 generally includes a taper tool 675, a loading tool 625 and a push plate 650. A low-friction coating may be used in the dry seal stretch operation to reduce the friction between the seal ring 135 and the components of the installation tool 600. In one embodiment, the low-friction coating may be applied to a portion of a taper 610 of the taper tool 675 and a portion of a lip 630 on the loading tool 625. In another embodiment, the low-friction coating may be applied to a portion of the seal ring 135. The low-friction coating may be a dry lubricant, such as Impregion or Teflon®.

As shown in FIG. 18, the seal ring 135 is moved up the taper 610 of the taper tool 675 in the direction indicated by arrow 620. The taper tool 675 is configured to change the seal ring 135 from a first configuration having a first inner diameter to a second configuration having a second larger inner diameter (e.g., stretch the seal ring). As illustrated, the loading tool 625 is positioned on a reduced diameter portion 640 of the taper tool 675 such that the lip 630 can receive the seal ring 135. The loading tool 625 is secured to the taper tool 675 by a plurality of connection members 615, such as screws. After the seal ring is in the second configuration, the seal ring 135 is moved to the lip 630 of the loading tool 625.

Figure 19:
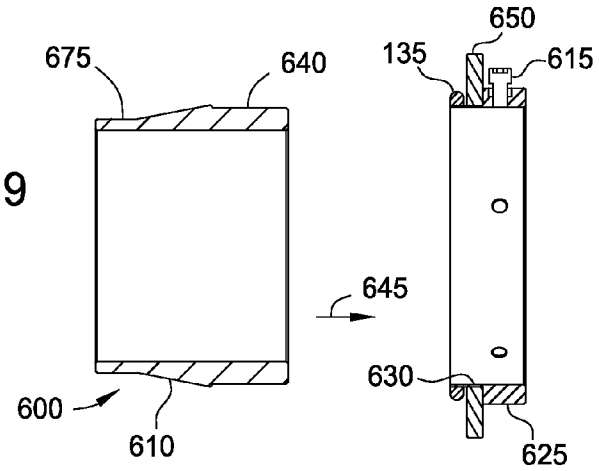
FIG. 19 illustrates a view of a loading tool with the seal ring.
Figure 20:
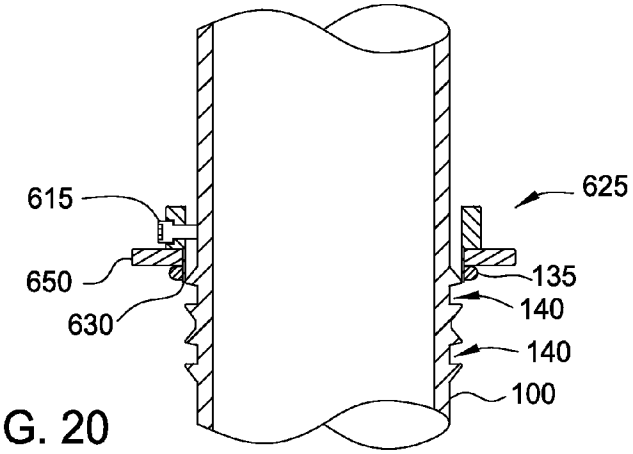
FIG. 20 illustrates a view of the loading tool on the expandable hanger.

FIG. 19 illustrates a view of the loading tool 625 with the seal ring 135. The loading tool 625 and the push plate 650 are removed from the end 615 of the taper tool 600 in the direction indicated by arrow 645. Generally, the loading tool 625 is an annular tool that is configured to receive and hold the seal ring 135 in the second configuration (e.g., large inner diameter). FIG. 20 illustrates a view of the loading tool 625 and the push plate 650 on the expandable hanger 100. The loading tool 625 is positioned on the hanger 100 such that the lip 630 of the loading tool 625 (and seal ring 135) is located adjacent the gland 140. Thereafter, the loading tool 625 is secured to the hanger 100 by the plurality of connection members 615. Prior to placing the seal ring 135 in the gland 140, a bonding material, such as glue, is applied to the selective sides of the gland 140.

Figure 21:
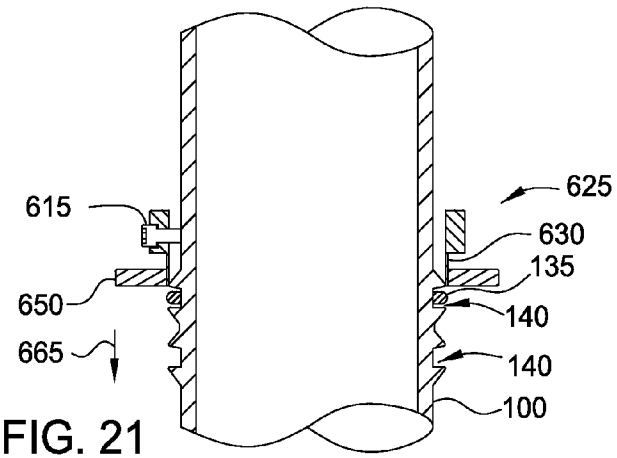
FIG. 21 illustrates a view of a push plate urging the seal ring into a gland of the expandable hanger.

FIG. 21 illustrates a view of the push plate 650 and the loading tool 625. During the dry seal stretch operation, the push plate 650 engages the seal member 135 as the push plate 650 is moved in a direction indicated by arrow 665. The push plate urges the seal ring 135 off the lip 630 of the loading tool 625 and into the gland 140 of the hanger 100. This sequence of steps may be repeated for each seal ring 135.

Figure 22:
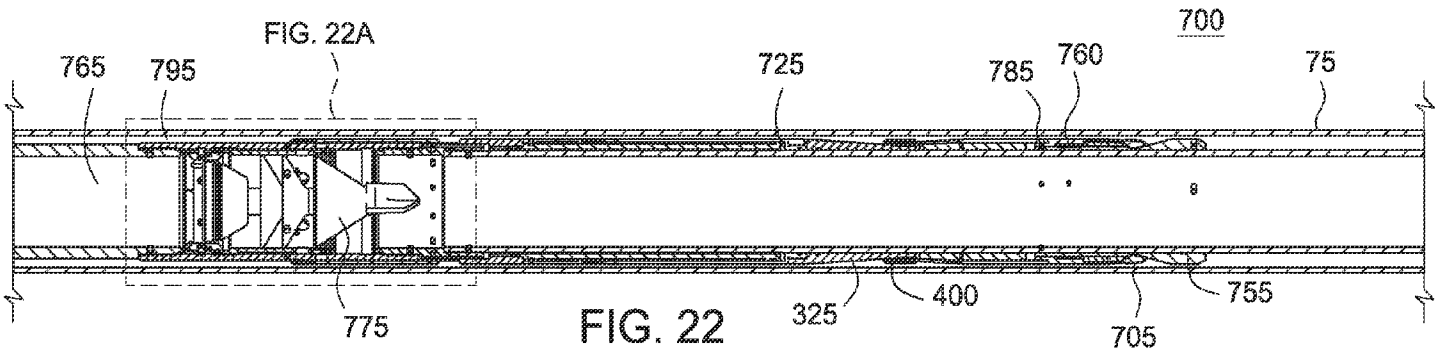
FIGS. 22 and 22A illustrate views of a pack-off stage tool.
Figure 22A:
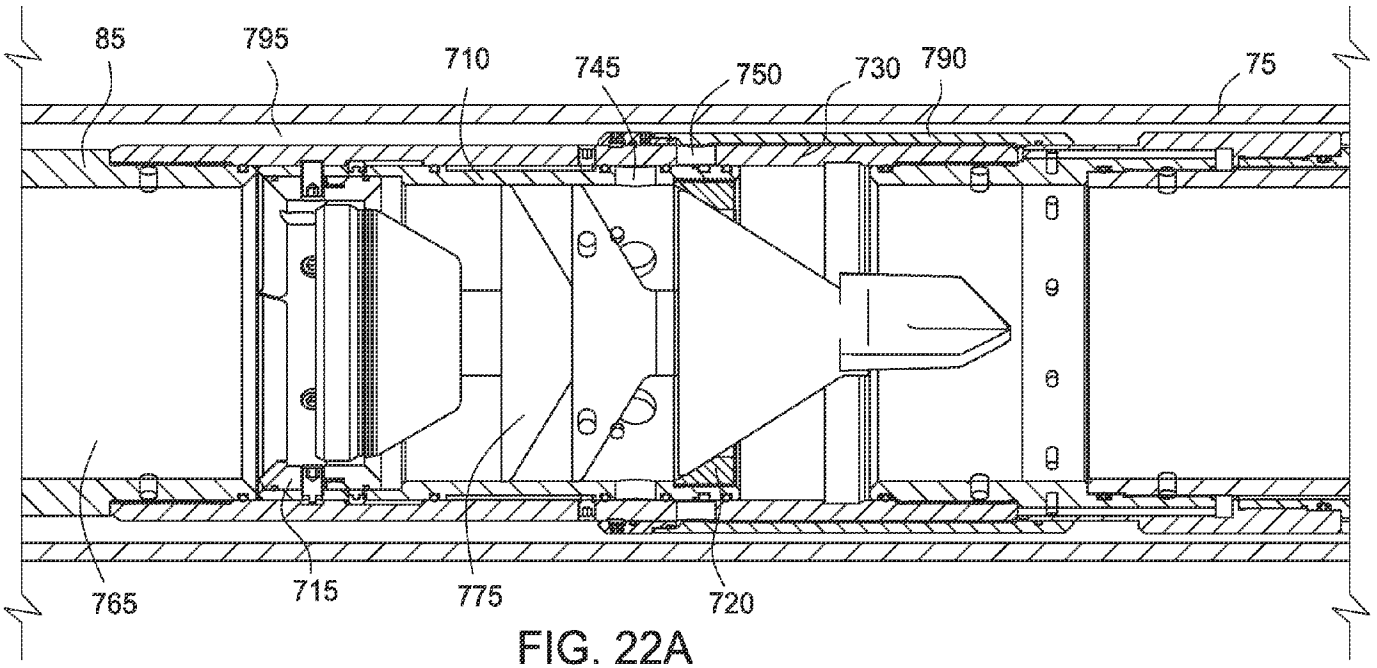

As mentioned herein, the packing element 400 may be used with different downhole tools. For instance, the packing element 400 may be used as a back-up for a compression or inflatable element, or in conjunction with a stage tool, or integral with a pack-off stage tool. FIGS. 22 and 22A illustrate an example of the packing element with a pack-off stage tool 700. For convenience, the components in the stage tool 700 that are similar to the components in the downhole tool 300 will be labeled with the same number indicator. The stage tool 700 is attached to casing 85 and lowered into the wellbore 75. The stage tool 700 is used during a cementing operation to inject cement into an annulus 795 formed between the casing 85 and the wellbore 75 at specified locations in the wellbore 75. As shown, the stage tool 700 includes the packing element 400, the expansion cone 325, a mechanical piston assembly 725 and slips 705.

As shown in FIG. 22, the stage tool 700 includes slips 705 and a gauge ring 755. The slips 705 are configured to travel along the gauge ring 755 upon activation of the slips 705. The stage tool 700 further includes a self-adjusting locking mechanism which allows the slips 705 to travel in one direction and prevents travel in the opposite direction. The locking mechanism is implemented as a lower locking ring 760. Upon activation, the slips 705 are configured to grip the wellbore 75 to support the stage tool 700 in the wellbore 75.

In another embodiment, an anchor portion (i.e., rough surface on the surfaces 430A-C on the packing element 400) may be used in place of the slips 705 to support the stage tool 700 in the wellbore 75, thus reducing the number of components in the stage tool 700 and reducing the overall length of the stage tool 700. As set forth herein, the length and/or the size of the surfaces 430A-C may be arranged such that when the packing element 400 is set, a sufficient gripping force is created between the anchor portion and the surrounding wellbore 75 to support the downhole tool 300 within the wellbore 75. The surfaces 430A-C may also be induction hardened so that the surfaces 430A-C penetrate the surface of the wellbore 75 to provide a robust anchoring means upon activation of the packing element 400.

FIG. 22A illustrates a view of an upper end of the stage tool 700. As shown, the stage tool 700 includes an inner sleeve 710 with ports 745 and a body member 730 with ports 750. As will be described herein, the inner sleeve 710 is configured to move relative to the body member 730 to align the ports 745, 750 and thus create a fluid pathway between an inside portion and an outside portion of the stage tool 700. The stage tool 700 further includes a closing seat 715 and an opening seat 720. The stage tool 700 also includes an upper lock ring 740 that is attached to a housing via shear screws 735. Additionally, the stage tool 700 includes an external sleeve 790.

As shown in FIG. 22A, a plug 775 is disposed in the stage tool 700. After the stage tool 700 is located in the wellbore 75, the plug 775 is dropped into the stage tool 700. The plug 775 moves through a bore 765 of the stage tool 700 until it contacts the opening seat 720 in the inner sleeve 710. The plug 775 is configured to block fluid communication through the bore 765 of the stage tool 700.

Figure 23:
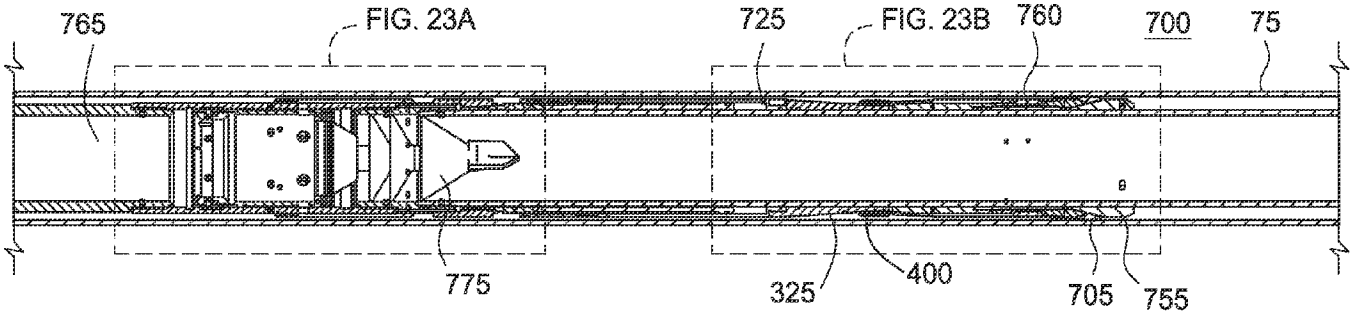
FIGS. 23, 23A and 23B illustrate the activation of slips in the stage tool.
Figure 23A:
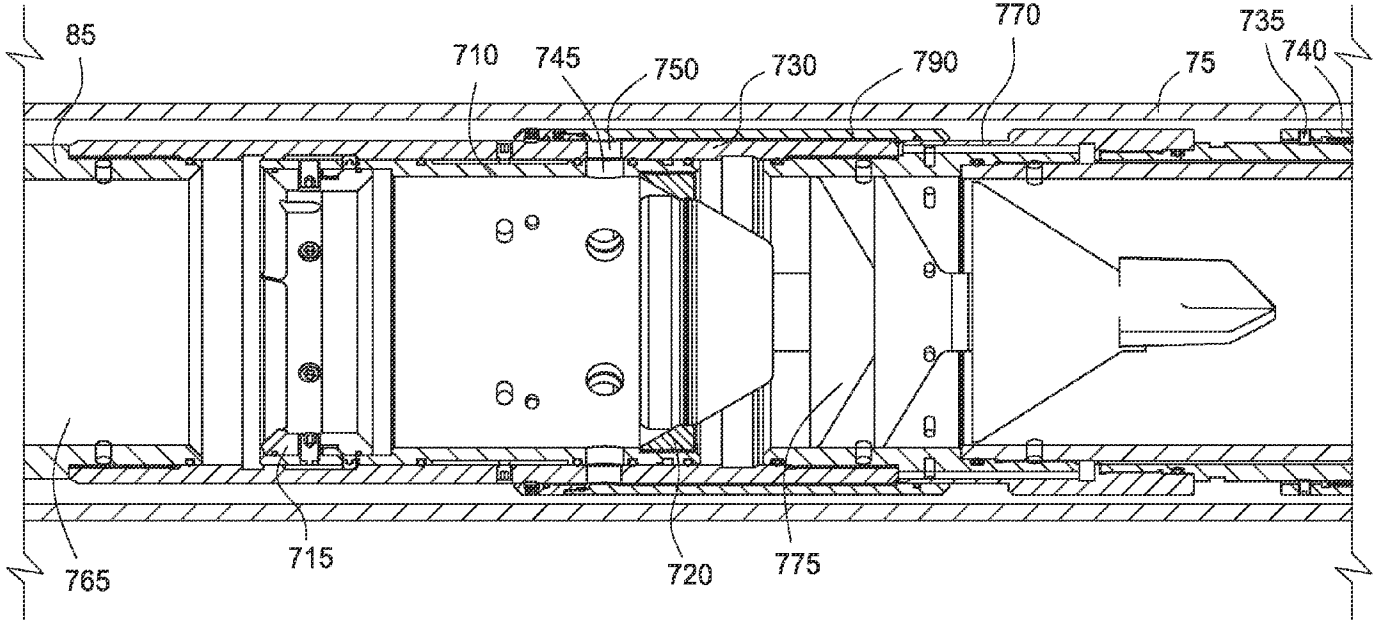
Figure 23B:
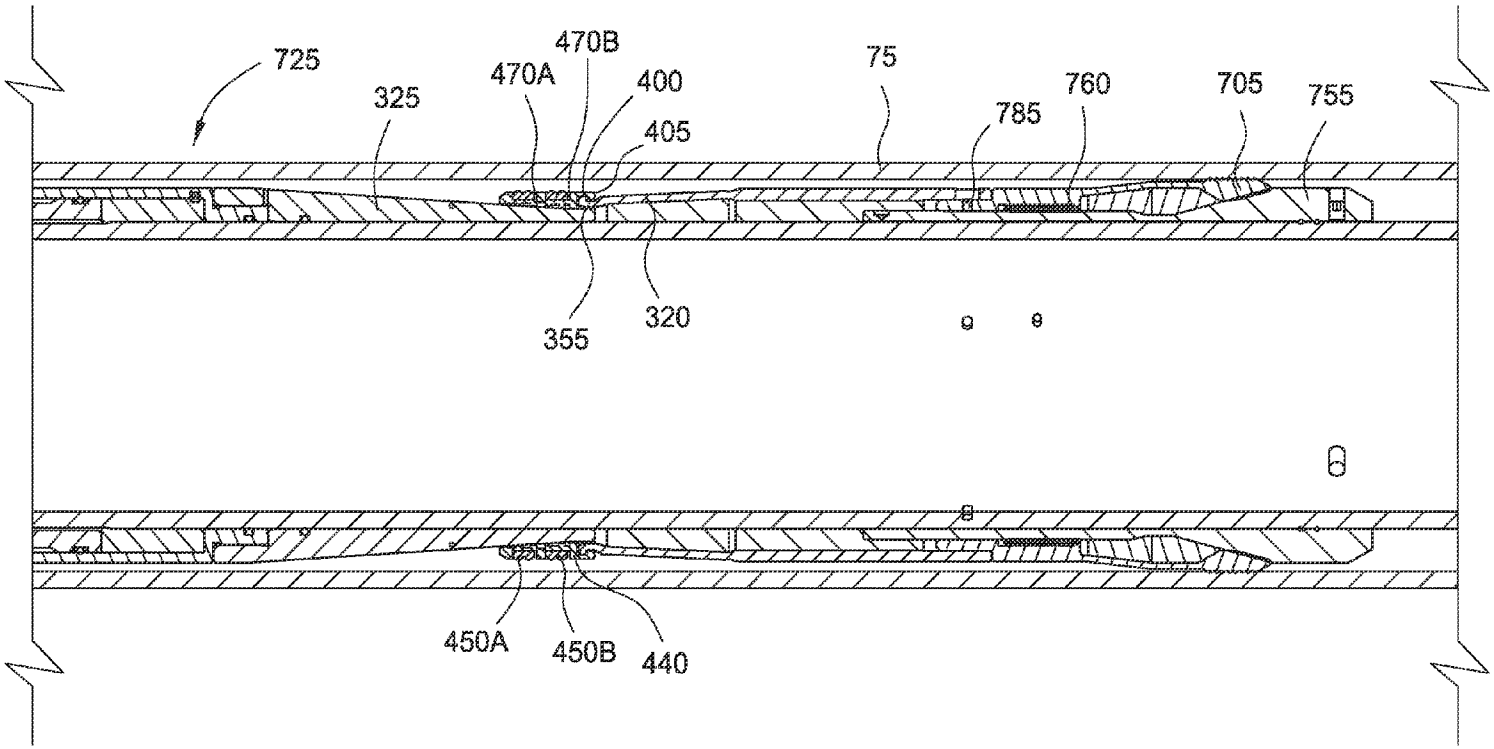

FIGS. 23, 23A and 23B illustrate the activation of the slips 705 in the stage tool 700. After the plug 775 blocks fluid communication through the bore 765 of the stage tool 700, the fluid pumped from the surface creates a fluid pressure within the bore 765 of the stage tool 700. At a predetermined pressure, the inner sleeve 710 moves relative to the body member 730 until the ports 745 in the inner sleeve 710 align with the ports 750 in the body member.

After the ports 745, 750 are aligned, fluid in the bore 765 may flow through the ports 745, 750 into a fluid passageway 770 to set the packing element 400 and the slips 705. The fluid moving through the fluid passageway 770 generates a fluid pressure which causes the mechanical piston assembly 725 to apply a force on the wedge member 325 which is subsequently applied to the retaining sleeve 320. The force on the retaining sleeve 325 causes shear pin 785 to break and allows the slips 705 to move along the gauge ring 755. The movement of the slips 705 in a first direction relative to the gauge ring 755 causes the slips 705 to move radially outward and engage the wellbore 75, as shown in FIG. 23B. The self-adjusting locking mechanism (i.e., locking ring 760) prevents travel in the slips 705 in a second opposite direction. The slips 705 and the packing element 400 are configured such that the force to break the shear pin 785 is less than the force to move the packing element 400 along the expansion cone 325. As a result, the shear pin 785 breaks and the slips 705 move along the gauge ring 755 prior to the movement of the packing element 400 along the expansion cone 325. After the slips 705 have been set, the retaining sleeve 325 moves under the packing element 400, as set forth herein.

The packing element 400 may be configured such that a force of a preselected magnitude is required in order to radially expand it during the packer setting process. This radial expansion is effected by the axial movement of wedge member 325 with respect to the packing element 400. Therefore, because of the angle of inclination of the wedge member 325 and friction between the wedge member 325 and packing element 400, the radial force required to radially expand packing element 400 can be correlated to a corresponding axial force which must be applied to the wedge member 325 in order to achieve relative movement between wedge member 325 and packing element 400. Hence, there exists a threshold axial force which must be applied to the wedge member 325 in order to radially expand packing element 400.

In operation, an axial force may be applied to the wedge member 325 (and therefore onto the packing element 400) which is less than this threshold axial force. In such instances, the applied axial force is communicated from the wedge member 325 to the packing element 400, and from the packing element 400 to collet fingers 355, and the retaining sleeve 320 without the packing element 805 experiencing any radial expansion (or any substantial radial expansion). Therefore, such an applied axial force less than the threshold axial force may be applied through the packing element 400 in order to effect the operation of another tool and/or another part of the same tool, such as setting slips 705 as described herein.

Furthermore, in operation, an axial force may be applied to the wedge member 325 (and therefore onto the packing element 400) which is greater than the aforementioned threshold axial force. In such instances, if there exists little or no available space for the packing element 400, collet fingers 355, and the retaining sleeve 320 to move axially, then the wedge member 325 may move axially with respect to the packing element 400. In this way, the wedge member 325 is forced further under the packing element 400, resulting in radial expansion of the packing element 400, which may continue until the packing element 400 has been moved to its set position in the wellbore.

In another embodiment, the aforementioned threshold axial force may be preselected by including a latch and/or a shearable fastening between the wedge member 325 and the packing element 400. This threshold axial force may be preselected by the configuration and (for example) selection of construction materials of the packing element 400 alone, or in combination with the configuration and selection of a suitable latch and/or shearable fastening between the wedge member 325 and the packing element 400.

In practice, by way of example, the aforementioned threshold axial force may be circa 10,000 lbs, though other magnitudes above and below this figure are contemplated, and may be tailored to suit specific applications.

Figure 24:
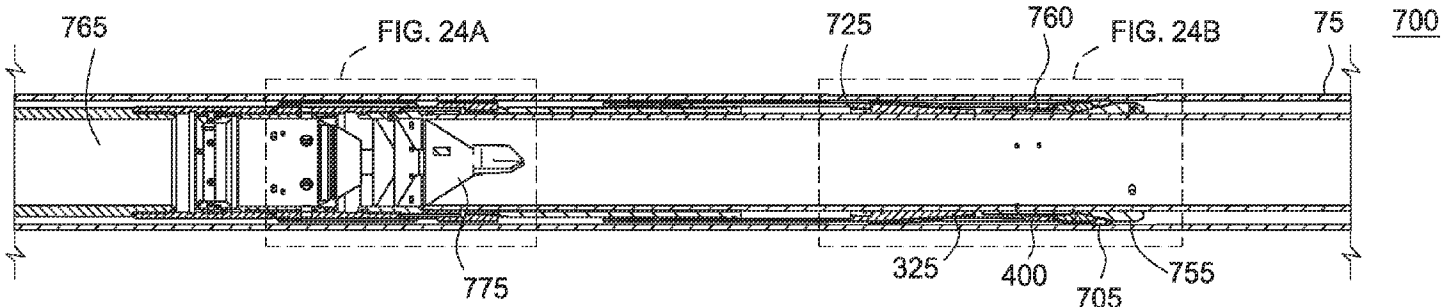
FIGS. 24, 24A and 24B illustrate the activation of a packing element in the stage tool.
Figure 24B:
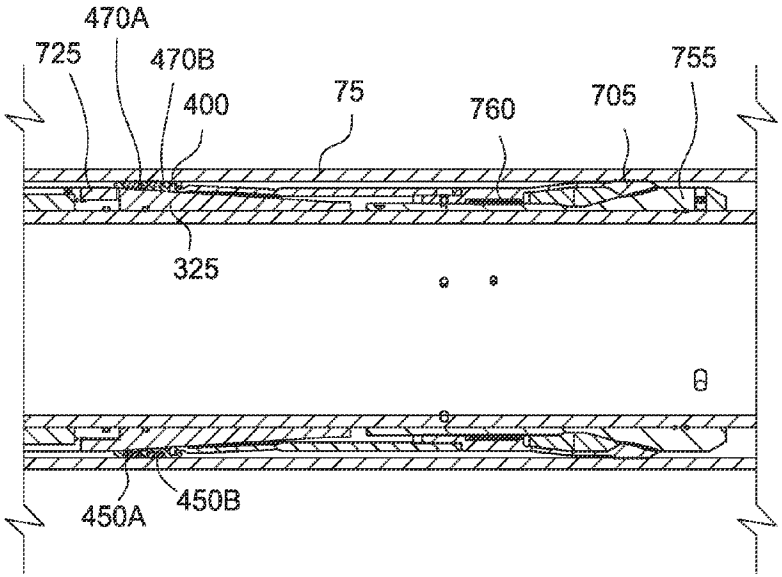
Figure 24A:
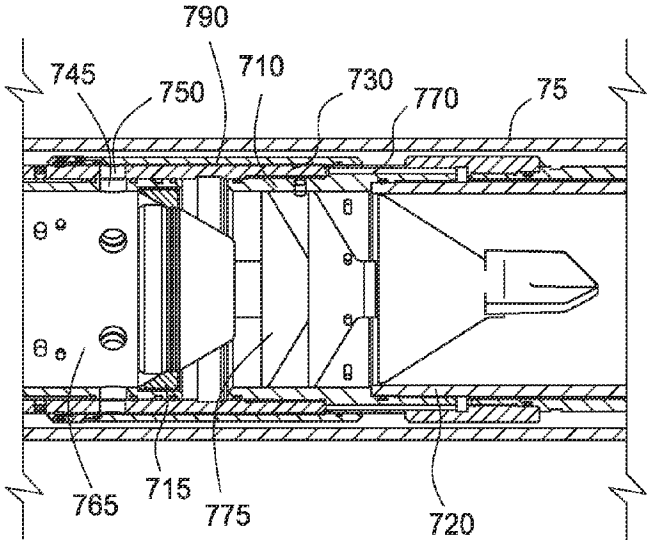

FIGS. 24, 24A and 24B illustrate the activation of the packing element 400 in the stage tool 700. After the slips 705 have engaged the wellbore 75, the fluid pressure generated by the fluid moving through the fluid passageway 770 causes the mechanical piston assembly 725 to activate the packing element 400. In a similar manner as described herein, the wedge member 325 is urged under the tubular body 440 of the packing element 400. As a result, the packing element 400 moves radially outward into contact with the wellbore 75, and a seal is formed between the stage tool 700 and the wellbore 75.

Figure 25:
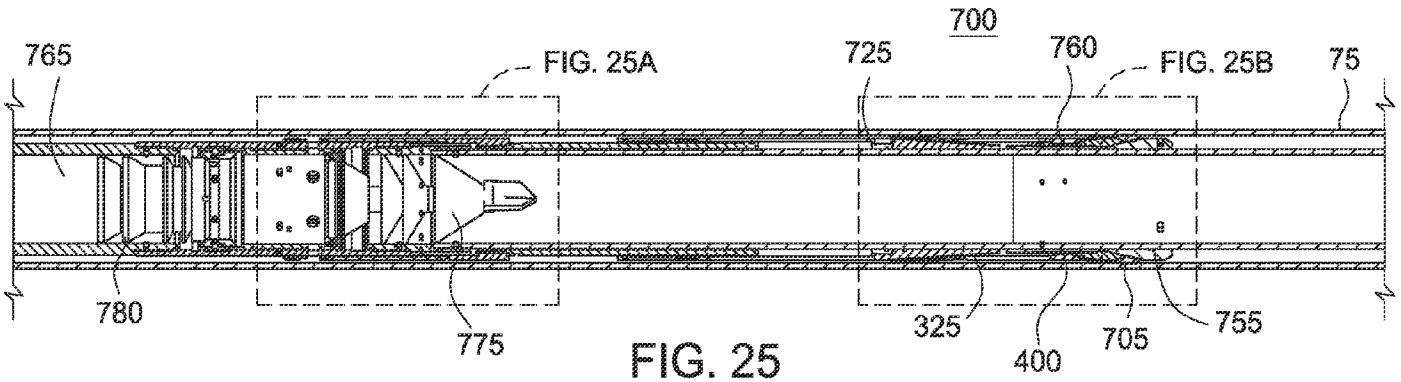
FIGS. 25, 25A and 25B illustrate the movement of an external sleeve in the stage tool.
Figure 25B:
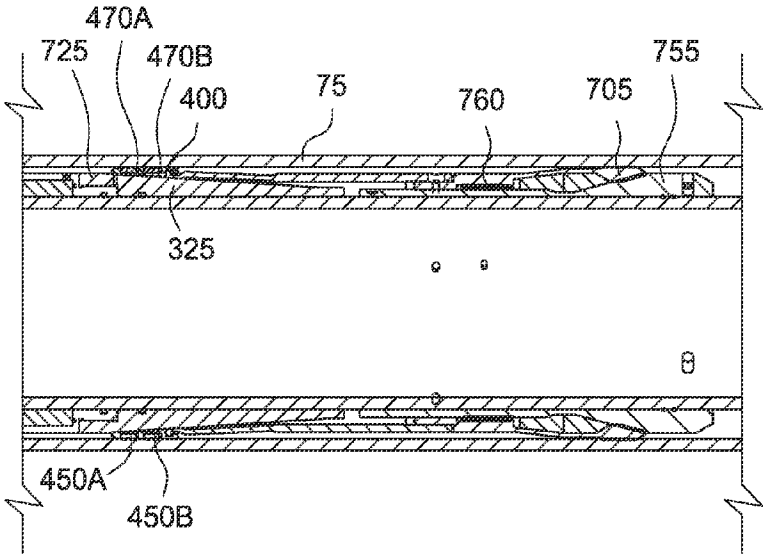
Figure 25A:
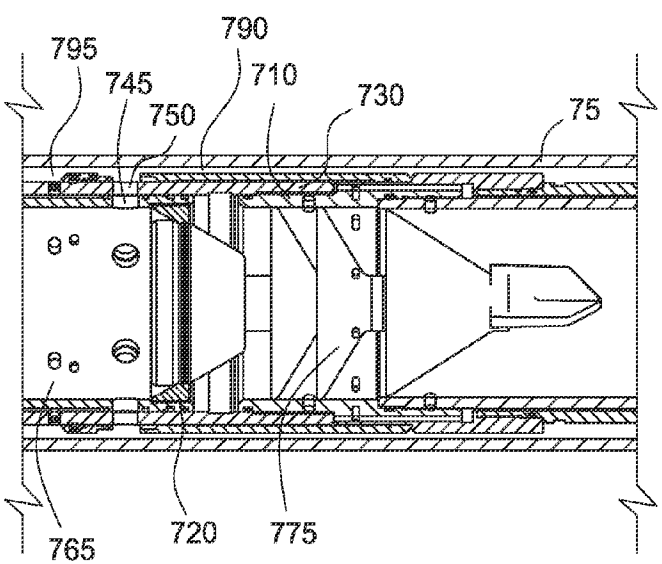

FIGS. 25, 25A and 25B illustrate the movement of the external sleeve 790 of the stage tool 700. After the packing element 400 and the slips 705 have engaged the wellbore 75, the fluid pressure generated by the fluid moving through the fluid passageway 770 causes the external sleeve 790 to move relative to the body member 730. The movement of the external sleeve 790 exposes the ports 745, 750, as shown in FIG. 25A. The exposure of the ports 745, 750 opens a fluid passageway between the bore 765 of the stage tool 700 and the annulus 795 formed between the stage tool 700 and the wellbore 75. Cement may be pumped through the bore 765, the ports 745, 750 and into the annulus 795 during the cementing operation. After the cementation operation is complete, the closing plug 780 is dropped into the stage tool 700.

Figure 26:
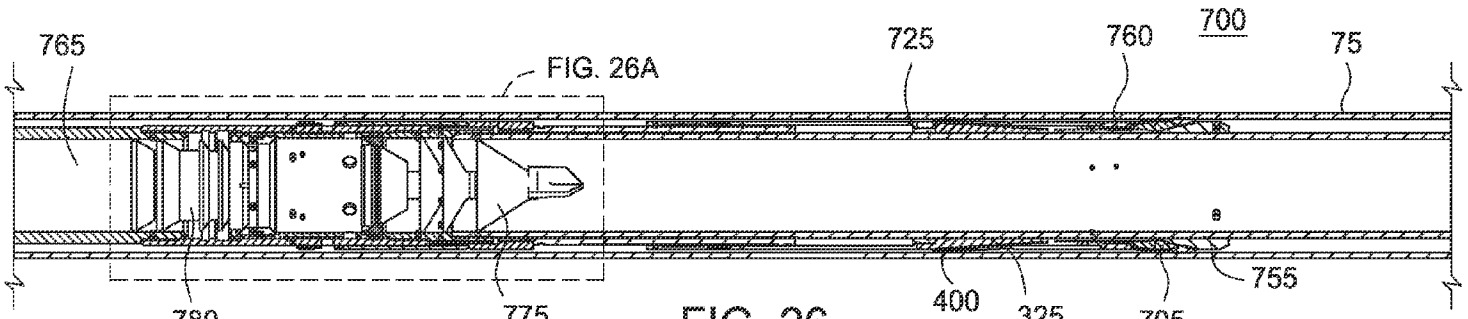
FIGS. 26 and 26A illustrate the closing of ports in the stage tool after the cementation operation is complete.
Figure 26A:
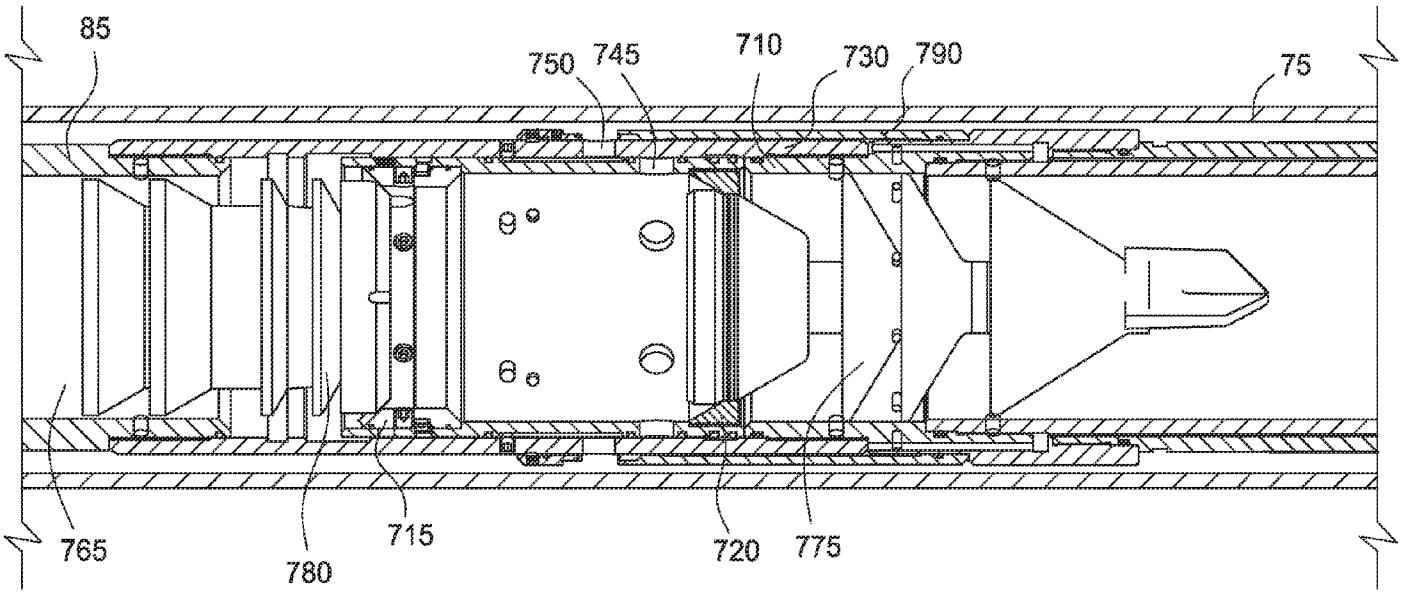

FIGS. 26 and 26A illustrate the closing of the ports 745, 750 of the stage tool 700 after the cementation operation is complete. The closing plug 780 moves through the bore 765 of the stage tool 700 until it contacts the closing seat 715 attached to the inner sleeve 710, as shown in FIG. 26A. The closing plug 780 is configured to block fluid communication through the bore 765 of the stage tool 700. The fluid pumped from the surface creates a fluid pressure within the bore 765 of the stage tool 700. At a predetermined pressure, the inner sleeve 710 moves relative to the body member 730 until the ports 745 in the inner sleeve 710 misalign with the ports 750 in the body member 730. At this point, fluid in the bore 765 may no longer flow through the ports 745, 750; thus the fluid passageway between the bore 765 and the annulus 795 is closed.

Figure 27:
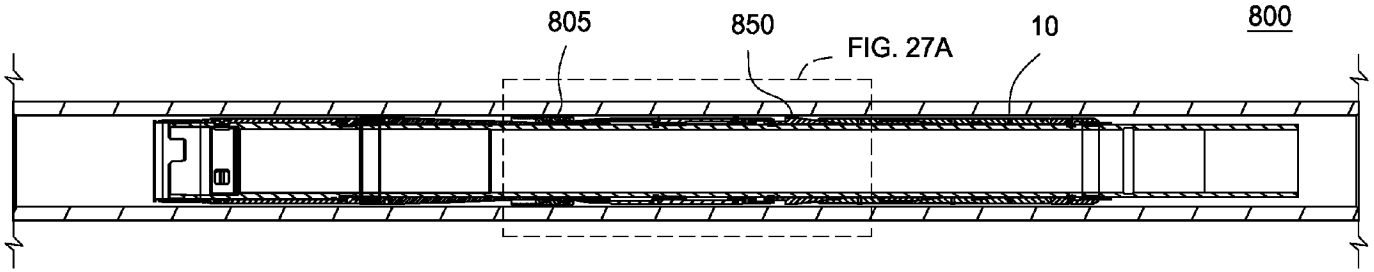
FIGS. 27 and 27A illustrate views of a downhole tool in a run-in (unset) position.
Figure 27A:
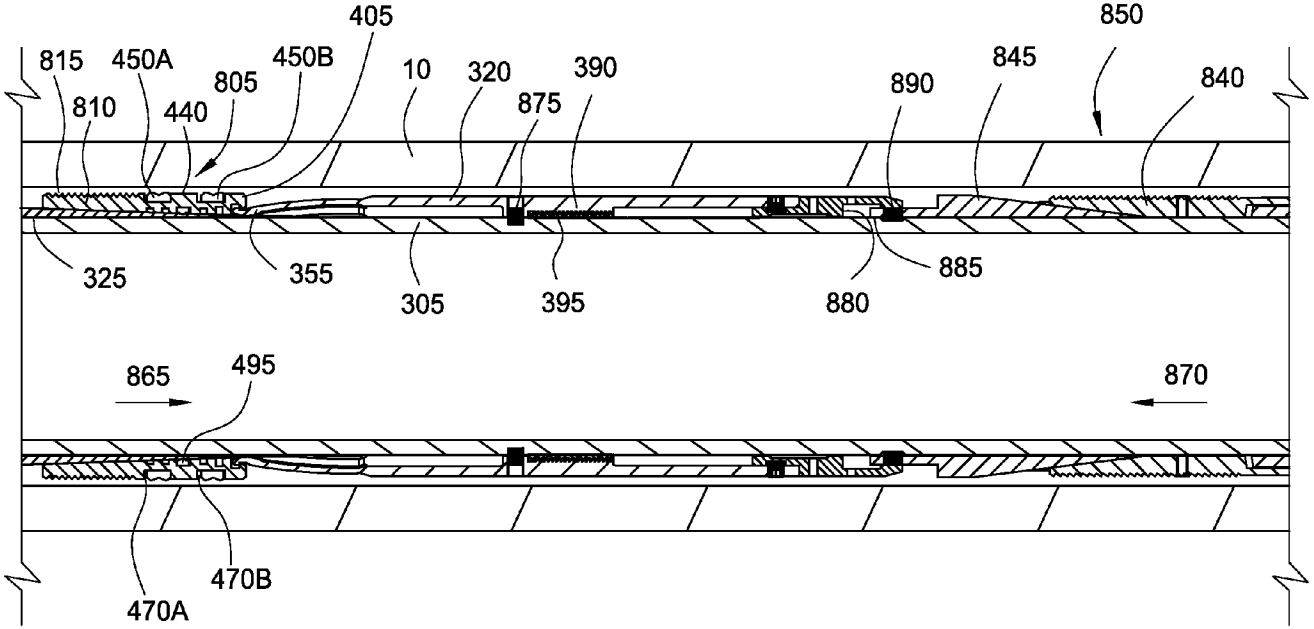

FIGS. 27 and 27A illustrate a downhole tool 800 in a run-in (unset) position. The downhole tool 800 may be used to seal a desired location in a wellbore. For convenience, the components in the tool 800 that are similar to the components in the tool 300 will be labeled with the same number indicator. The tool 800 includes a slip assembly 850 and a packing element 805.

The slip assembly 850 includes slips 840 and a wedge member 845. The wedge member 845 is generally cylindrical and slidably disposed about the mandrel 305. The downhole tool 800 includes a locking mechanism which allows the wedge member 845 to travel in one direction (arrow 865) and prevents travel in the opposite direction (arrow 870). In one embodiment, the locking mechanism is implemented as a ratchet ring 390 is disposed on a ratchet surface 395 of the mandrel 305. The ratchet ring 390 is recessed into, and carried by, the sleeve 320. In this case, the interface of the ratchet ring 390 and the ratchet surface 395 allows the sleeve 320 and the wedge member 845 to travel only in the direction as indicated by arrow 865. As shown, the sleeve 320 is attached to the wedge member 845 by a dog 890, and the sleeve is attached to the mandrel 305 by a shear pin 875.

The packing element 805 includes a tubular body 440, which is an annular member. The tubular body 440 includes an optional grip member 810 with a grip surface 815. The grip member 810 is configured to engage the casing 10 upon activation of the packing element 805. In a similar manner as described herein, the wedge member 325 is configured to move axially along the outer surface of the mandrel 305. The packing element 805 is prevented from moving with respect to the wedge member 325. As a result, the packing element 805 is forced to slide over the tapered surface of the wedge member 325. The positive inclination of the tapered surface urges the packing element 805 into a diametrically expanded position.

The packing element 805 may be configured such that a force of a preselected magnitude is required in order to radially expand it during the packer setting process. This radial expansion is effected by the axial movement of wedge member 325 with respect to the packing element 805. Therefore, because of the angle of inclination of the wedge member 325 and friction between the wedge member 325 and packing element 805, the radial force required to radially expand packing element 805 can be correlated to a corresponding axial force which must be applied to the wedge member 325 in order to achieve relative movement between wedge member 325 and packing element 805. Hence, there exists a threshold axial force which must be applied to the wedge member 325 in order to radially expand packing element 805.

In operation, an axial force may be applied to the wedge member 325 (and therefore onto the packing element 805) which is less than this threshold axial force. In such instances, the applied axial force is communicated from the wedge member 325 to the packing element 805, and from the packing element 805 to collet fingers 355, and retaining sleeve 320 without the packing element 805 experiencing any radial expansion (or any substantial radial expansion). Therefore, such an applied axial force less than the threshold axial force may be applied through the packing element 805 in order to effect the operation of another tool and/or another part of the same tool, such as setting slips 840 as described hereafter.

Furthermore, in operation, an axial force may be applied to the wedge member 325 (and therefore onto the packing element 805) which is greater than the aforementioned threshold axial force. In such instances, if there exists little or no available space for the packing element 805, collet fingers 355, and retaining sleeve 320 to move axially, then the wedge member 325 may move axially with respect to the packing element 805. In this way, the wedge member 325 is forced further under the packing element 805, resulting in radial expansion of the packing element 805, which may continue until the packing element 805 has been moved to its set position in the wellbore.

In another embodiment, the aforementioned threshold axial force may be preselected by including a latch and/or a shearable fastening between the wedge member 325 and the packing element 805. This threshold axial force may be preselected by the configuration and (for example) selection of construction materials of the packing element 805 alone, or in combination with the configuration and selection of a suitable latch and/or shearable fastening between the wedge member 325 and the packing element 805.

In practice, by way of example, the aforementioned threshold axial force may be circa 10,000 lbs, though other magnitudes above and below this figure are contemplated, and may be tailored to suit specific applications.

Figure 28:
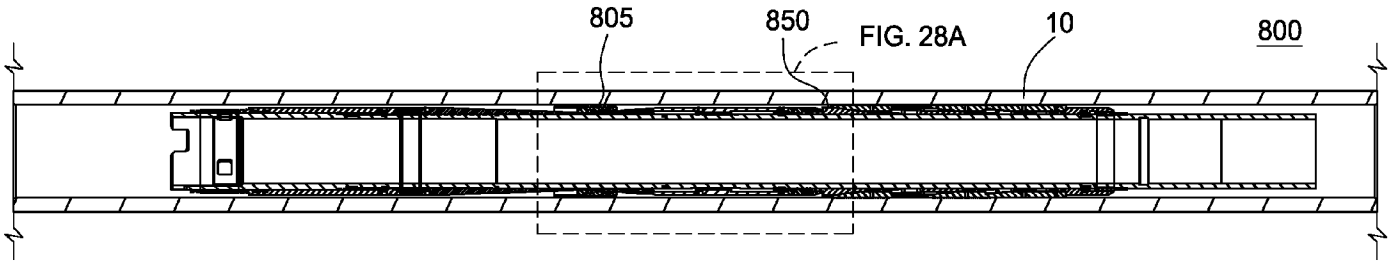
FIGS. 28 and 28A illustrate the setting of slips in the downhole tool.
Figure 28A:
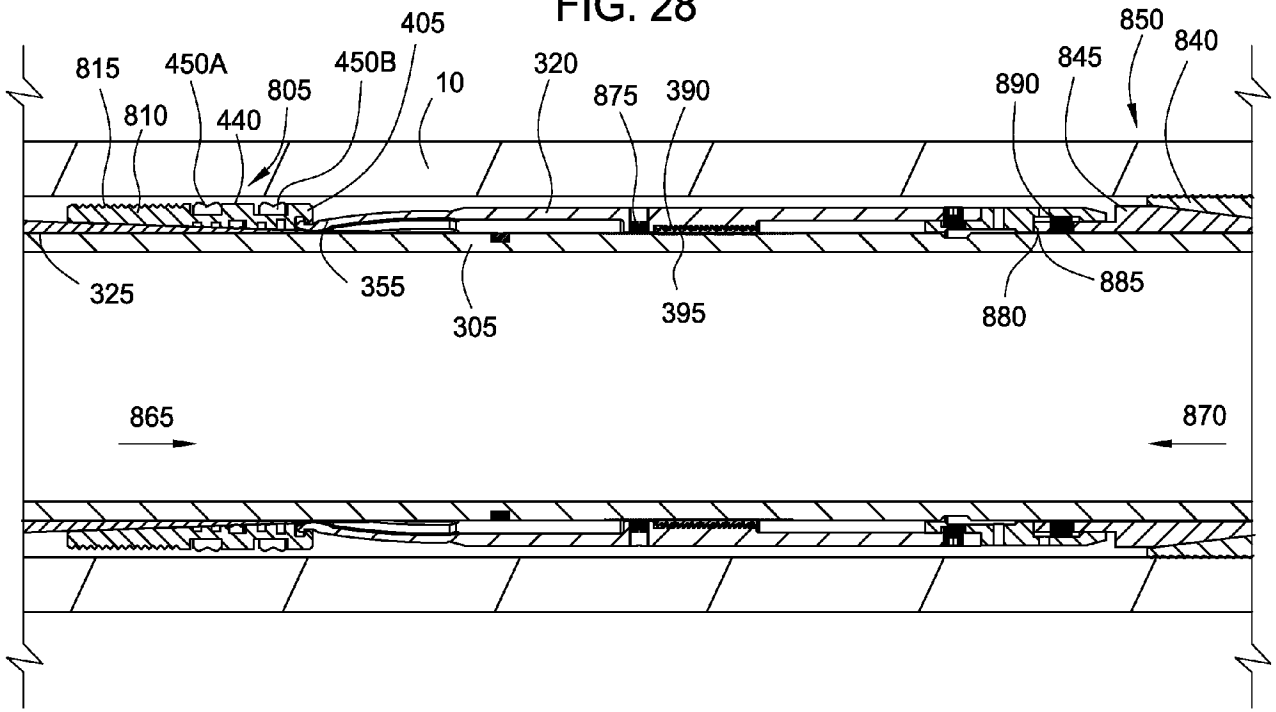

FIGS. 28 and 28A illustrate the setting of the slips 840 in the tool 800. In the embodiment shown, the setting sequence for the tool 800 is to set the slip assembly 850 (FIG. 28A) and then set the packing element 805 (FIG. 29A). In another embodiment, the packing element 805 may be set, and then the slip assembly 850 may be set.

To set the slip assembly 850, an actuator sleeve (not shown) is driven axially in the direction of arrow 865. The axial movement of the actuator sleeve may be caused by, for example, applied mechanical force from the weight of a tubing string or hydraulic pressure acting on a piston. The actuator sleeve applies a force on the wedge member 325, which drives the wedge member 325 axially along the outer surface of the mandrel 305. The movement of the sleeve 320 along the outer surface of the mandrel 305 toward the wedge member 845 causes the shear pin 875 to break. Thereafter, the sleeve 320 moves along the mandrel 305 thereby allowing the dog 890 to be released. The sleeve 320 moves until a surface 880 of the sleeve 320 contacts an end surface 885 of the wedge member 845 (compare FIGS. 27A and 28A). At this point, the sleeve 320 urges the wedge member 845 under the slips 845. As a result, the slips 840 expand radially outward and engage the casing 10.

Figure 29:
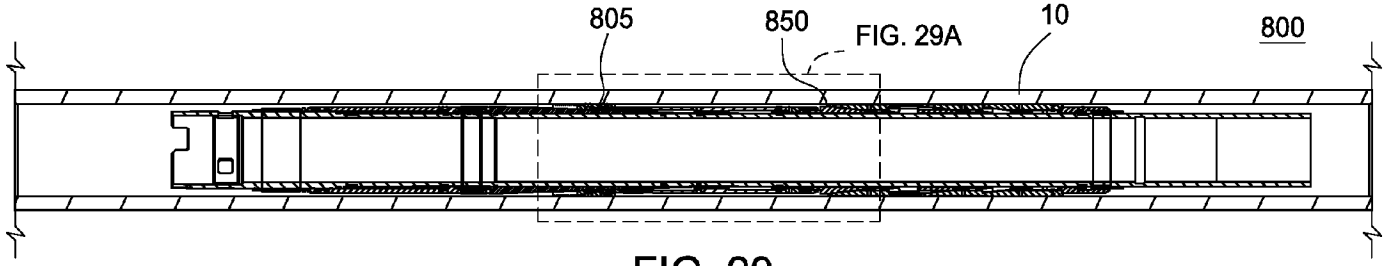
FIGS. 29 and 29A illustrate the setting of a packing element in the downhole tool
Figure 29A:
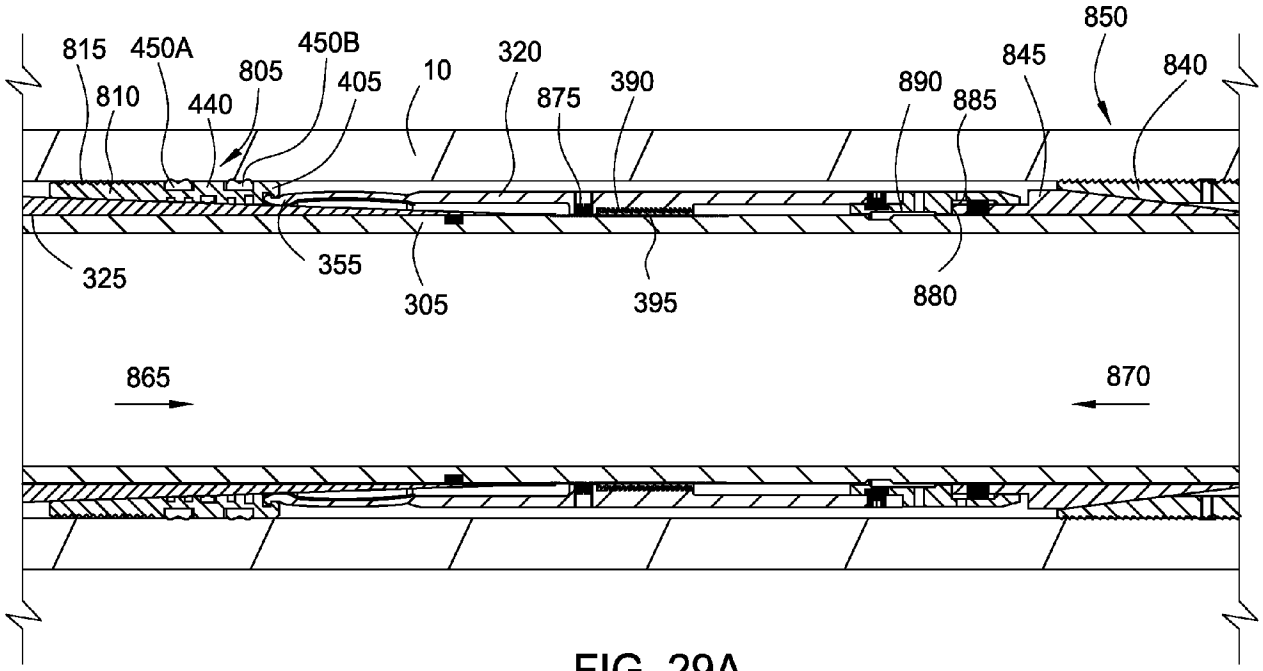

FIGS. 29 and 29A illustrate the setting of the packing element 805 in the tool 800. After the slip assembly 850 has been set, the packing element 805 is set. To set the packing element 805, the actuator sleeve drives the wedge member 325 axially along the outer surface of the mandrel 305 in a similar manner as described herein. With continuing travel over the mandrel 305, the wedge member 325 is driven underneath the packing element 805. The packing element 805 is prevented from moving with respect to the wedge member 325 by the provision of the ratchet ring 390 and the ratchet surface 395. As a result, the packing element 400 is forced to slide over the tapered surface 375. The positive inclination of the tapered surface urges the packing element 805 into a diametrically expanded position. As the packing element 805 expands radially outward, the gripping surface 815 of the gripping member 810 engages the wellbore. The gripping member 810 may be used to hold the packing sealing elements 450A-B in place by preventing movement of the packing element 805. In other words, the gripping member 810 ensures that the packing sealing elements 450A-B do not move with respect to the casing 10 when subjected to high differential pressure, thus allowing the packing sealing elements 450A-B to maintain the sealing relationship with the casing 10. In one embodiment, the gripping surface 815 is induction hardened or similar means so that the gripping surface 815 penetrates an inner surface of the casing 10 to provide a robust anchoring means when the packing element 805 is activated. In this manner, the gripping member 810 may be used to help resist axial movement of the packing sealing elements 450A-B relative to the casing 10 when the packing sealing elements 450A-B are subjected to high differential pressure.

Figure 30:
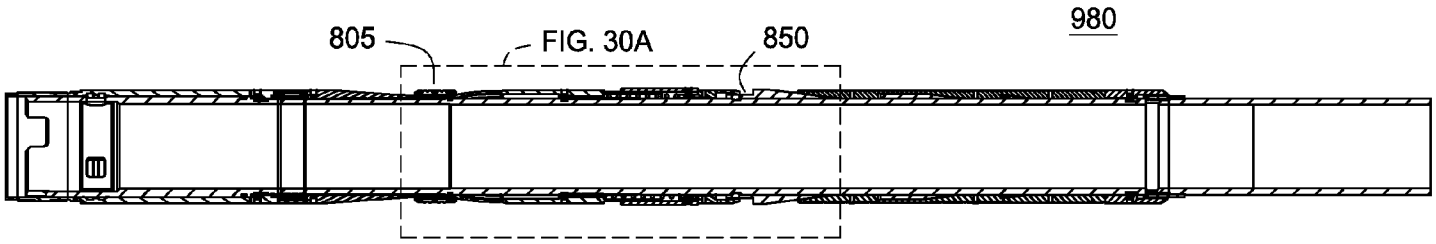
FIGS. 30 and 30A illustrate views of a downhole tool in a run-in (unset) position.
Figure 30A:
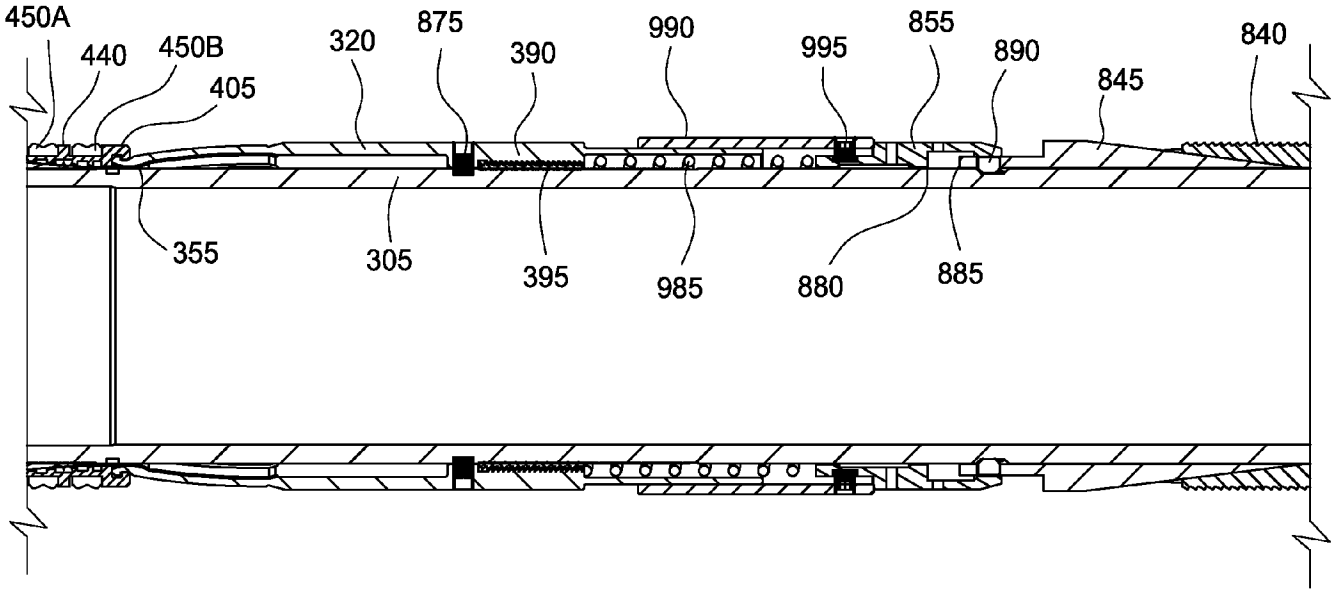

FIGS. 30 and 30A illustrate views of a downhole tool 980 in a run-in (unset) position. For convenience, the components in the tool 980 that are similar to the components in the tool 300 and tool 800 will be labeled with the same number indicator. The tool 980 includes a biasing member 985, such as a spring, between the sleeve 320 and the sleeve 855. A sleeve 990 is attached to sleeve 855 via a lock screw 995. The tool 980 operates in a similar manner as tool 800. The biasing member is configured to apply a biasing force on the wedge member 845 after the slips 840 are set (see FIG. 28A). In other words, after the shear pin 875 breaks and the dogs 890 are released, the movement of the sleeve 320 along the mandrel 305 causes the biasing member 985 to be compressed between sleeves 320, 855. The sleeve 320 is locked in one direction and is able to move in the other direction due to the locking mechanism 390, 395. Thus, the compressed biasing member 985 applies a biasing force on the wedge member 845 (via the sleeve 855). The biasing force may be used to maintain the wedge member 845 under the slip 840 after the slips 840 have been set.

Figure 31:
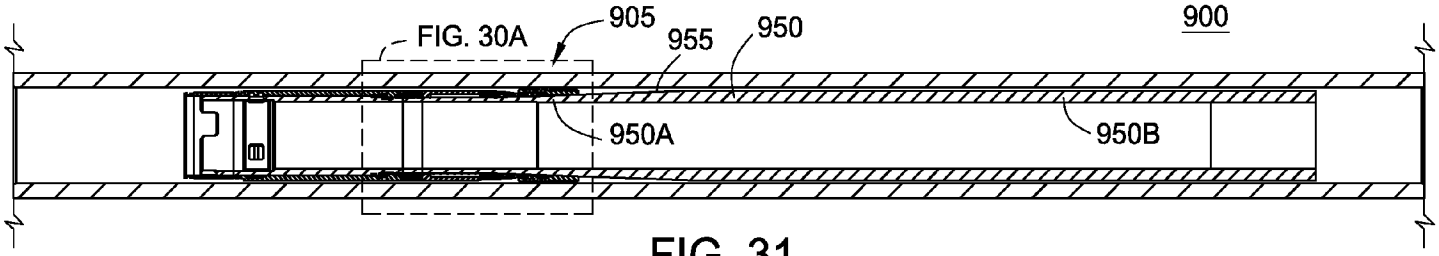
FIGS. 31 and 31A illustrate a downhole tool in a run-in (unset) position.
Figure 31A:
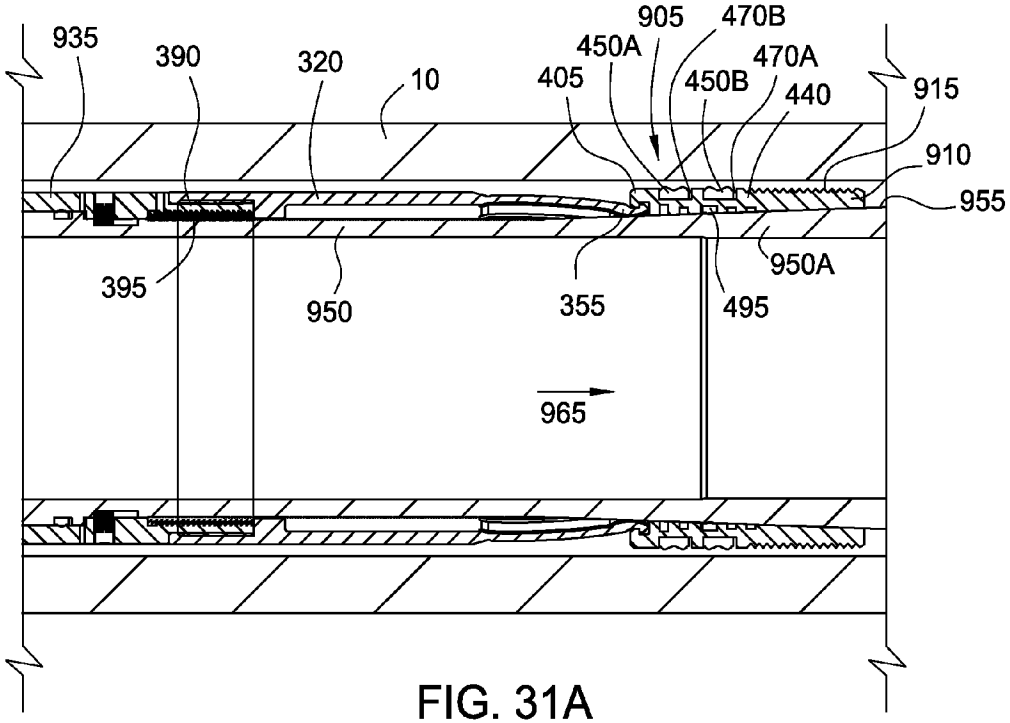

FIGS. 31 and 31A illustrate a downhole tool 900 in a run-in (unset) position. For convenience, the components in the tool 900 that are similar to the components in the tool 300 will be labeled with the same number indicator. The tool 900 includes a packing element 905 that may be used to seal a desired location in a wellbore. The packing element 905 is held in place by the retaining sleeve 320. The packing element 905 may be coupled to the retaining sleeve 320 by a variety of locking interfaces. In one embodiment, the retaining sleeve 320 includes a plurality of collet fingers 355. The terminal ends of the collet fingers 355 are interlocked with the annular lip 405 of the packing element 905.

The packing element 905 includes the tubular body 440, which is an annular member. The tubular body 440 has an anchor 910 with a grip surface 915. The anchor 910 is configured to engage the casing 10 upon activation of the packing element 905. The anchor 910 may be used in place of a gripping member (not shown) in the downhole tool 900. Rather than having a separate gripping member, such as slips, on the downhole tool 900, the anchor 910 may be configured to hold the downhole tool 900 within the casing 10, thus reducing the number of components in the downhole tool 900 and reducing the overall length of the downhole tool 900. Other benefits of using the anchor 910 (rather than separate slips) would be that the overall stroke length of the downhole tool 900 would be reduced; elimination of potential leak paths and manufacturing costs would be reduced without compromising performance. The length and/or the size of the grip surface 915 may be arranged such that when the packing element 905 is set, a sufficient gripping force is created between the anchor 910 and the surrounding casing 10 to support the downhole tool 900 within the wellbore.

The downhole tool 900 includes a self-adjusting locking mechanism which allows the retaining sleeve 320 to travel in one direction and prevents travel in the opposite direction. The locking mechanism is implemented as a ratchet ring 390 disposed on a ratchet surface 395 of a mandrel 950. The ratchet ring 390 is recessed into, and carried by, the retaining sleeve 320. In this case, the interface of the ratchet ring 390 and the ratchet surface 395 allows the retaining sleeve 320 to travel only in the direction of the arrow 965, relative to the mandrel 950.

As shown in FIG. 31, the mandrel 950 has an outer tapered surface 955. As such, the mandrel 950 has a first portion 950A with a first thickness and a second portion 950B with a greater second thickness. As will be described herein, the packing element 905 is urged along the tapered surface 955 of the mandrel 950 during the setting process. The use of the tapered surface 955 of the mandrel 950 to activate the packing element 905, rather than having a separate wedge member, reduces the number of components in the downhole tool 900 and reduces the overall length of the downhole tool 900. Other benefits of using the tapered surface 955 of the mandrel 950 (rather than a separate wedge member) would be the elimination of potential leak paths between the separate wedge member and the mandrel, and manufacturing costs would be reduced without compromising performance. Another benefit of using the tapered surface 955 of the mandrel 950 would be that the added thickness of the mandrel 950 provides ultra high pressure body integrity below the packing element 905.

Figure 32:
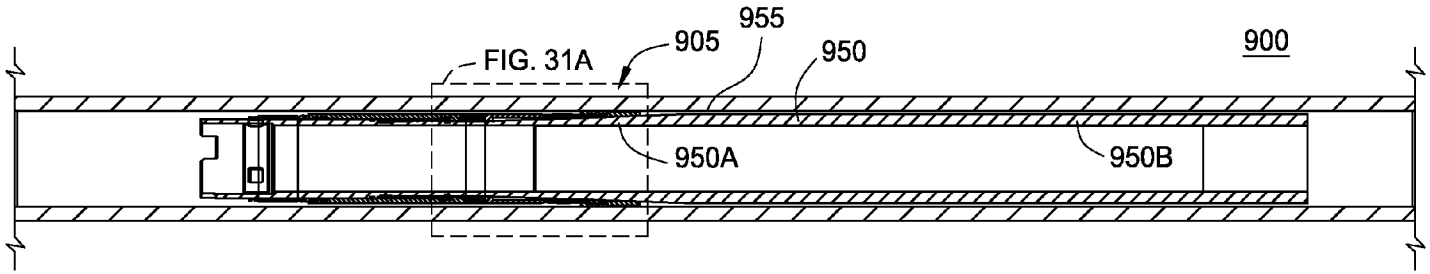
FIGS. 32 and 32A illustrate the downhole tool in a set position.
Figure 32A:
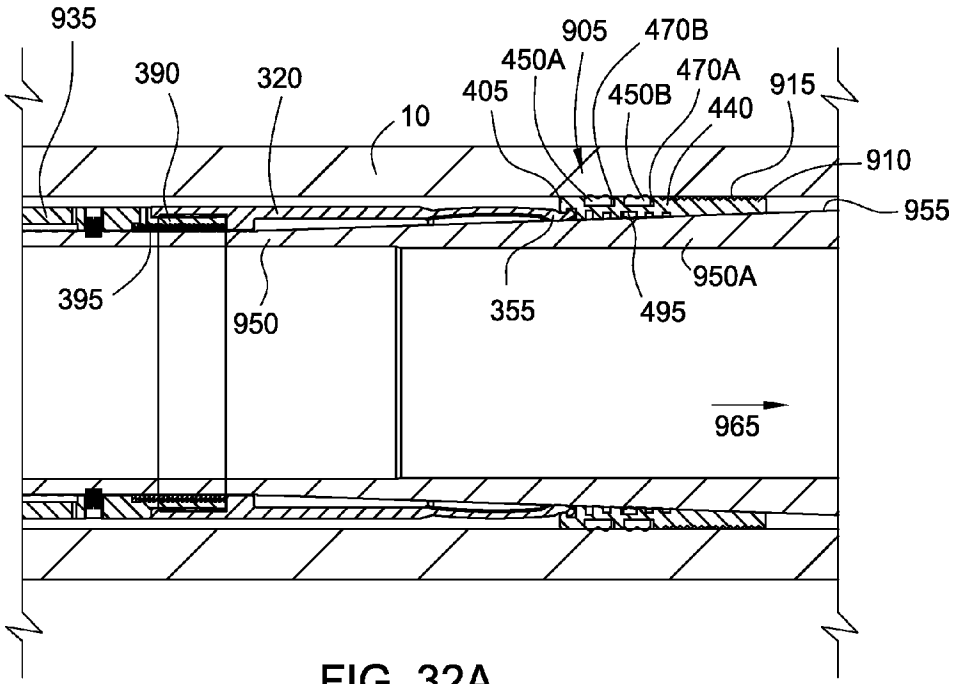

FIGS. 32 and 32A illustrate the downhole tool 900 in a set position. To set the downhole tool 900, an actuator sleeve 935 is driven axially in the direction of the arrow 965. The axial movement of the actuator sleeve 935 may be caused by, for example, applied mechanical force from the weight of a tubing string or hydraulic pressure acting on a piston. The actuator sleeve 935, in turn, drives the retaining sleeve 320 and the packing element 905 axially along the tapered surface 955 of the mandrel 950. The ratchet ring 390 and the ratchet surface 395 ensure that the retaining sleeve 320 and the packing element 905 travel only in the direction of the arrow 965. With continuing travel over the mandrel 950, the packing element 905 moves along the tapered surface 955 into a diametrically expanded position. The set position of the downhole tool 900 is shown in FIG. 32A.

In the set position, the packing element 905 is urged into contact with the casing 10 to form a fluid-tight seal and the gripping surface 915 of the anchor 910 engages the casing 10. The anchor 910 may be used to support the tool 900 in the casing 10. Additionally, the anchor 910 may be used to hold the packing sealing elements 450A-B in place by preventing movement of the packing element 905. More specifically, the anchor 910 ensures that the packing sealing elements 450A-B do not move with respect to the casing 10 when subjected to high differential pressure, thus allowing the packing sealing elements 450A-B to maintain the sealing relationship with the casing 10, while at the same time reducing wear on the packing element 905. In one embodiment, the gripping surface 915 of the anchor 910 is induction hardened or similar means so that the gripping surface 915 penetrates an inner surface of the casing 10 to provide a robust anchoring means when the packing element 905 is activated. In this manner, the anchor 910 may be used to support the tool 900 within the casing 10 and also help resist axial movement of the packing sealing elements 450A-B relative to the casing 10 when the packing sealing elements 450A-B are subjected to high differential pressure.

In one embodiment, an anchoring seal assembly for creating a seal portion and an anchor portion between a first tubular that is disposed within a second tubular is provided. The anchoring seal assembly includes an expandable annular member attached to the first tubular. The annular member has an outer surface and an inner surface. The anchoring seal assembly further includes a seal member disposed in a groove formed in the outer surface of the expandable annular member. The seal member has one or more anti-extrusion spring bands embedded within the seal member, wherein the outer surface of the expandable annular member adjacent the groove includes a rough surface. The anchoring seal assembly also includes an expander sleeve having a tapered outer surface and an inner bore. The expander sleeve is movable between a first position in which the expander sleeve is disposed outside of the expandable annular member and a second position in which the expander sleeve is disposed inside of the expandable annular member, wherein the expander sleeve is configured to radially expand the expandable annular member into contact with an inner wall of the second tubular to create the seal portion and the anchor portion as the expander sleeve moves from the first position to the second position.

In another embodiment, a method of creating a seal portion and an anchor portion between a first tubular and a second tubular is provided. The method includes the step of positioning the first tubular within the second tubular. The first tubular has an annular member with a groove and a rough outer surface, wherein a seal member with at least one anti-extrusion band is disposed within the groove and wherein a gap is formed between a side of the seal member and a side of the groove. The method further includes the step of expanding the annular member radially outward, which causes the at least one anti-extrusion band to move toward an interface area between the first tubular and the second tubular. The method also includes the step of urging the annular member into contact with an inner wall of the second tubular to create the seal portion and the anchor portion between the first tubular and the second tubular.

In one embodiment, a seal assembly for creating a seal between a first tubular and a second tubular is provided. The seal assembly includes an annular member attached to the first tubular, the annular member having a groove formed on an outer surface of the annular member. The seal assembly further includes a seal member disposed in the groove, the seal member having one or more anti-extrusion bands. The seal member is configured to be expandable radially outward into contact with an inner wall of the second tubular by the application of an outwardly directed force supplied to an inner surface of the annular member. Additionally, the seal assembly includes a gap defined between the seal member and a side of the groove.

In one aspect, the gap is configured to close upon expansion of the annular member. In another aspect, the gap is configured to close completely upon expansion of the annular member. In a further aspect, a portion of the seal member is used to close the gap. In an additional aspect, the one or more anti-extrusion bands comprise a first anti-extrusion band and a second anti-extrusion band. In yet a further aspect, the first anti-extrusion member is embedded on a first side of the seal member and the second anti-extrusion band is embedded on a second side of the seal member. In another aspect, the first anti-extrusion band and the second anti-extrusion band are springs. In a further aspect, the first anti-extrusion band and the second anti-extrusion band are configured to move toward a first interface area and a second interface area between the annular member and the second tubular upon expansion of the annular member. In an additional aspect, the first interface area is adjacent a first side of the groove and the second interface area is adjacent a second side of the groove.

In one aspect, the seal member is configured to move into the gap upon expansion of the seal member. In another aspect, a second gap is defined between the seal member and another side of the groove. In a further aspect, a biasing member disposed within the gap. In an additional aspect, a plurality of cutouts formed on an inner surface of the annular member. In another aspect, the annular member is a liner hanger. In yet a further aspect, the annular member is a packer.

In another embodiment, a method of creating a seal between a first tubular and a second tubular is provided. The method includes the step of positioning the first tubular within the second tubular, the first tubular having a annular member with a groove, wherein a seal member with at least one anti-extrusion band is disposed within the groove and wherein a gap is formed between a side of the seal member and a side of the groove. The method further includes the step of expanding the annular member radially outward, which causes the first anti-extrusion band and the second anti-extrusion band to move toward a first interface area and a second interface area between the annular member and the second tubular. The method also includes the step of urging the seal member into contact with an inner wall of the second tubular to create the seal between the first tubular and the second tubular.

In one aspect, the gap is closed between the seal member and the groove upon expansion of the annular member. In another aspect, the gap is closed by filling the gap with a portion of the seal member. In a further aspect, an expander tool is urged into the annular member to expand the annular member radially outward. In an additional aspect, the expander tool is removed from the annular member after the expansion operation. In yet another aspect, the expander tool remains within the annular member after the expansion operation.

In yet another embodiment, a seal assembly for creating a seal between a first tubular and a second tubular is provided. The seal assembly includes an annular member attached to the first tubular, the annular member having a groove formed on an outer surface thereof. The seal assembly further includes a seal member disposed in the groove of the annular member such that a side of the seal member is spaced apart from a side of the groove, the seal member having one or more anti-extrusion bands, wherein the one or more anti-extrusion bands move toward an interface area between the annular member and the second tubular upon expansion of the annular member.

In one aspect, the one or more anti-extrusion bands comprise a first anti-extrusion band and a second anti-extrusion band. In another aspect, the first anti-extrusion band and the second anti-extrusion band are configured to move into an annular gap formed between the annular member and the second tubular after expansion of the annular member due to downhole pressure. In a further aspect, at least one side of the seal member is attached to the groove via glue.

In a further embodiment, a hanger assembly is provided. The hanger assembly includes an expandable annular member having an outer surface and an inner surface. The hanger assembly further includes a seal member disposed in a groove formed in the outer surface of the expandable annular member, the seal member having one or more anti-extrusion spring bands embedded within the seal member. The hanger assembly also includes an expander sleeve having a tapered outer surface and an inner bore. The expander sleeve is movable between a first position in which the expander sleeve is disposed outside of the expandable annular member and a second position in which the expander sleeve is disposed inside of the expandable annular member. The expander sleeve is configured to radially expand the expandable annular member as the expander sleeve moves from the first position to the second position.

In one aspect, a gap formed between a side of the seal member and a side of the groove which is configured to close as the expander sleeve moves from the first position to the second position. In another aspect, a second seal member disposed in a second groove formed in the inner surface of the expandable annular member, the second seal member having one or more anti-extrusion spring bands embedded within the seal member. In another aspect, the second seal member is configured to create a seal with the expander sleeve.

While the foregoing is directed to embodiments of the present invention, other and further embodiments of the invention may be devised without departing from the basic scope thereof, and the scope thereof is determined by the claims that follow.

The invention claimed is:

1. A downhole tool for use in a wellbore, the tool comprising:

a body having a bore;

a seal assembly, comprising:

a wedge member disposed along the body; and a metallic packing element carrying an inner elastomeric seal engaged with the wedge member and an outer elastomeric seal for engagement with the wellbore;

a slip assembly disposed along the body, comprising slips and a gage ring, the slips movable along an inclined surface of the gage ring for engagement with the wellbore;

a retention sleeve fastened to the packing element and coupled to the slips; and an actuation assembly disposed along the body for moving the slips along the gage ring and for causing relative movement of the wedge member relative to a tapered inner surface of the metallic packing element.

2. The downhole tool of claim 1, wherein the outer elastomeric seal is disposed in a groove formed in an outer surface of the metallic packing element.

3. The downhole tool of claim 2, wherein the wedge member includes a tapered outer surface and an inner bore.

4. The downhole tool of claim 3, wherein the wedge member is configured to radially expand the metallic packing element as the wedge member moves from a first position to a second position.

5. The downhole tool of claim 4, wherein a gap is formed between a side of the outer elastomeric seal and a side of the groove, the gap being configured to close as the wedge member moves from the first position to the second position.

6. The downhole tool of claim 3, further comprising a sleeve member disposed in the bore of the body.

7. The downhole tool of claim 6, wherein the sleeve member is movable in the bore of the body between a first position in which a port in the body is blocked and a second position in which the port in body is unblocked.

8. The downhole tool of claim 7, wherein a fluid pathway is created between the bore of the body and an outside portion of the downhole tool when the sleeve member is in the second position.

9. The downhole tool of claim 1, further comprising:

anti-extrusion bands embedded within the outer elastomeric seal.

10. The downhole tool of claim 9, wherein the metallic packing element is expanded radially outward from the body when the wedge member moves from a first position to a second position.

11. A method of using the downhole tool of claim 1, comprising;

running a tubular string having the downhole tool of claim 1 into the wellbore;

pumping an opener plug to the downhole tool, thereby opening a stage valve of the opener plug;

pressurizing the actuation assembly through the open stage valve;

pumping cement slurry through the open stage valve;

pumping a closer plug to the tool, thereby driving the cement slurry into an annulus between the tubular string and the wellbore and closing the stage valve.

12. The method of claim 11, further comprising moving a sleeve member within the bore of the body to block a port in the body.

13. The method of claim 11, wherein the slips are expanded and then the metallic packing element is expanded.

14. The downhole tool of claim 11, wherein the outer elastomeric seal is disposed in a groove formed in an outer surface of the metallic packing element.

15. The downhole tool of claim 14, wherein a gap is formed between a side of the outer elastomeric seal and a side of the groove, the gap being configured to close when the metallic packing element expands radially outward.

16. The downhole tool of claim 11, further comprising a shearable member disposed between the metallic packing element and the wedge member.

* * * * *

UNITED STATES PATENT AND TRADEMARK OFFICE

CERTIFICATE OF CORRECTION

PATENT NO. : 8,997,882 B2
APPLICATION NO. : 13/398833
DATED : April 7, 2015
INVENTOR(S) : Turley et al.

It is certified that error appears in the above-identified patent and that said Letters Patent is hereby corrected as shown below:

Claims:

Column 26, Claim 11, Line 64, please delete "opener plug" and insert --downhole tool-- therefor.

Signed and Sealed this
Twenty-fourth Day of November, 2015

Michelle K. Lee

Michelle K. Lee
*Director of the United States Patent and Trademark Office*